US008545321B2

(12) United States Patent
Baerlocher et al.

(10) Patent No.: US 8,545,321 B2
(45) Date of Patent: Oct. 1, 2013

(54) GAMING SYSTEM HAVING USER INTERFACE WITH UPLOADING AND DOWNLOADING CAPABILITY

(75) Inventors: Anthony J. Baerlocher, Reno, NV (US); Kimberly M. Campbell, Reno, NV (US); Christiaan R. Champagne, Las Vegas, NV (US); Dwayne A. Davis, Reno, NV (US); Hans Elias, Reno, NV (US); Damien C. Ennis, Reno, NV (US); Michael P. Khamis, Reno, NC (US); David N. Myers, Reno, NV (US); David M. Palmer, Reno, NV (US)

(73) Assignee: IGT, Las Vegas, NV (US)

( * ) Notice: Subject to any disclaimer, the term of this patent is extended or adjusted under 35 U.S.C. 154(b) by 886 days.

(21) Appl. No.: 12/267,207

(22) Filed: Nov. 7, 2008

(65) Prior Publication Data

US 2009/0131134 A1 May 21, 2009

Related U.S. Application Data

(60) Provisional application No. 60/986,858, filed on Nov. 9, 2007.

(51) Int. Cl.
*A63F 9/24* (2006.01)

(52) U.S. Cl.
USPC ..... 463/37

(58) Field of Classification Search
USPC ..... 463/37
See application file for complete search history.

(56) References Cited

U.S. PATENT DOCUMENTS

| | | | |
|---|---|---|---|
| 2,743,108 | A | 4/1956 | Sanders |
| 3,904,207 | A | 9/1975 | Gold |
| 4,363,485 | A | 12/1982 | Edwall |
| 4,582,324 | A | 4/1986 | Koza et al. |
| 4,618,150 | A | 10/1986 | Kimura |
| 4,652,998 | A | 3/1987 | Koza et al. |
| 4,659,087 | A | 4/1987 | Shen et al. |
| 4,695,053 | A | 9/1987 | Vazquez, Jr. et al. |
| 4,743,022 | A | 5/1988 | Wood |
| 4,775,155 | A | 10/1988 | Lees |

(Continued)

FOREIGN PATENT DOCUMENTS

| | | |
|---|---|---|
| EP | 0 449 433 | 10/1991 |
| EP | 0 874 337 | 10/1998 |

(Continued)

OTHER PUBLICATIONS

"What is Microsoft Surface?" www.programmerworld.net. Online. Sep. 6, 2007. Accessed via the Internet. Accessed Nov. 2, 2012. <URL:http://web.archive.org/web/20070906183549/http://faq.programmerworld.net/cool-gadgets/what-is-microsoft-surface.html>.*

(Continued)

*Primary Examiner* — Dmitry Suhol
*Assistant Examiner* — Carl V Larsen
(74) *Attorney, Agent, or Firm* — Neal, Gerber & Eisenberg LLP

(57) ABSTRACT

A game table having a multiplayer interactive display/input device which enables multiple players to simultaneously play primary or base wagering games and/or secondary or bonus games using the display/input device. The display/input device enables multiple players to simultaneously interact with the gaming system, the game table and the various games using the same display/input device. The gaming system also enables use of a card that is encoded or encrypted with a tag (such as an radio frequency tag) that the cameras or readers of the game table can detect. The card interacts with the display/input device of the game table.

18 Claims, 10 Drawing Sheets

(56) References Cited

U.S. PATENT DOCUMENTS 4,807,884 A 2/1989 Breeding
4,836,553 A 6/1989 Suttle et al.
4,844,464 A 7/1989 Berge
4,861,041 A 8/1989 Jones et al.
4,906,005 A 3/1990 Manabe
5,019,973 A 5/1991 Wilcox et al.
5,033,744 A 7/1991 Bridgeman et al.
5,087,405 A 2/1992 Maker
5,098,107 A 3/1992 Boylan et al.
5,102,135 A 4/1992 Addiechi
5,116,055 A 5/1992 Tracy
5,154,429 A 10/1992 LeVasseur
5,174,579 A 12/1992 Griffiths
5,205,555 A 4/1993 Hamano
5,248,142 A 9/1993 Breeding
5,275,400 A 1/1994 Weingardt et al.
5,275,416 A 1/1994 Schorr et al.
5,280,909 A 1/1994 Tracy
5,288,077 A 2/1994 Jones
5,288,081 A 2/1994 Breeding
5,292,127 A 3/1994 Kelly et al.
5,334,836 A 8/1994 Filo
5,342,047 A 8/1994 Heidel et al.
5,342,049 A 8/1994 Wichinsky et al.
5,344,144 A 9/1994 Canon
5,362,053 A 11/1994 Miller
5,364,105 A 11/1994 Jones
5,377,973 A 1/1995 Jones et al.
5,377,993 A 1/1995 Josephs
5,390,934 A 2/1995 Grassa
5,393,057 A 2/1995 Marnell, II
5,393,067 A 2/1995 Paulsen et al.
5,407,200 A 4/1995 Zalabak
5,411,271 A 5/1995 Mirando
5,417,430 A 5/1995 Breeding
5,431,407 A 7/1995 Hofberg et al.
5,452,899 A 9/1995 Skratulia et al.
5,454,570 A 10/1995 Karal
5,476,259 A 12/1995 Weingardt
5,494,296 A 2/1996 Grassa
5,529,309 A 6/1996 Bartlett
5,531,440 A 7/1996 Dabrowski et al.
5,536,016 A 7/1996 Thompson
5,542,669 A 8/1996 Charron et al.
5,560,603 A 10/1996 Seelig et al.
5,570,885 A 11/1996 Ornstein
5,577,731 A 11/1996 Jones
5,584,485 A 12/1996 Jones et al.
5,584,763 A 12/1996 Kelly et al.
5,597,162 A 1/1997 Franklin
5,611,730 A 3/1997 Weiss
5,615,888 A 4/1997 Lofink et al.
5,626,341 A 5/1997 Jones et al.
5,632,485 A 5/1997 Woodland et al.
5,636,838 A 6/1997 Caro
5,639,089 A 6/1997 Matsumoto et al.
5,641,730 A 6/1997 Brown
5,645,486 A 7/1997 Nagao et al.
5,649,705 A 7/1997 String
5,651,548 A 7/1997 French et al.
5,660,391 A 8/1997 Klasee
5,660,393 A 8/1997 Dreger
5,664,781 A 9/1997 Feola
5,673,917 A 10/1997 Vancura
5,678,821 A 10/1997 Hedman
5,685,774 A 11/1997 Webb
5,718,430 A 2/1998 Aramapakul et al.
5,720,483 A 2/1998 Trinh
5,735,742 A 4/1998 French
5,743,523 A 4/1998 Kelly et al.
5,755,440 A 5/1998 Sher
5,755,619 A 5/1998 Matsumoto et al.
5,761,647 A 6/1998 Boushy
5,769,716 A 6/1998 Saffari et al.
5,781,647 A 7/1998 Fishbine et al.
5,788,573 A 8/1998 Baerlocher et al.
5,788,574 A 8/1998 Ornstein et al.
5,794,964 A 8/1998 Jones et al.
5,795,225 A 8/1998 Jones et al.
5,806,846 A 9/1998 Lofink et al.
5,816,575 A 10/1998 Keller
5,823,873 A 10/1998 Moody
5,823,874 A 10/1998 Adams
5,830,063 A 11/1998 Byrne
5,833,536 A 11/1998 Davids et al.
5,833,537 A 11/1998 Barrie
5,839,730 A 11/1998 Pike
5,839,955 A 11/1998 Mangano et al.
5,845,906 A 12/1998 Wirth
5,848,932 A 12/1998 Adams
5,851,011 A 12/1998 Lott
5,851,148 A 12/1998 Brune et al.
5,855,515 A 1/1999 Pease et al.
5,857,678 A 1/1999 Coleman et al.
5,863,041 A 1/1999 Boylan et al.
5,873,781 A 2/1999 Keane
5,882,261 A 3/1999 Adams
5,890,962 A 4/1999 Takemoto
5,893,718 A 4/1999 O'Donnell
5,911,418 A 6/1999 Adams
5,911,419 A 6/1999 Delaney et al.
5,927,714 A 7/1999 Kaplan
5,935,002 A 8/1999 Falciglia
5,941,769 A 8/1999 Order
5,947,820 A 9/1999 Morro et al.
5,947,822 A 9/1999 Weiss
5,951,397 A 9/1999 Dickinson
5,967,894 A 10/1999 Kinoshita et al.
5,976,016 A 11/1999 Moody et al.
5,980,384 A 11/1999 Barrie
5,984,310 A 11/1999 English
5,997,401 A 12/1999 Crawford
6,007,066 A 12/1999 Moody
6,012,719 A 1/2000 Webb
6,015,346 A 1/2000 Bennett
6,019,369 A 2/2000 Nakagawa et al.
6,039,648 A 3/2000 Guinn et al.
6,039,650 A 3/2000 Hill
6,047,963 A 4/2000 Pierce et al.
6,050,895 A 4/2000 Luciano, Jr. et al.
6,053,823 A 4/2000 Mathews
6,056,641 A 5/2000 Webb
6,056,642 A 5/2000 Bennett
6,059,289 A 5/2000 Vancura
6,059,658 A 5/2000 Mangano et al.
6,062,981 A 5/2000 Luciano, Jr.
6,082,887 A 7/2000 Feuer et al.
6,089,976 A 7/2000 Schneider et al.
6,089,978 A 7/2000 Adams
6,093,102 A 7/2000 Bennett
6,095,525 A 8/2000 Terminel
6,102,798 A 8/2000 Bennett
6,110,039 A 8/2000 Oh
6,110,041 A 8/2000 Walker et al.
6,110,043 A 8/2000 Olsen
6,120,031 A 9/2000 Adams
6,120,377 A 9/2000 McGinnis, Sr. et al.
6,126,541 A 10/2000 Fuchs
6,126,542 A 10/2000 Fier
6,126,547 A 10/2000 Ishimoto
6,131,908 A 10/2000 Palmer
6,135,884 A 10/2000 Hedrick et al.
6,135,885 A 10/2000 Lermusiaux
6,139,013 A 10/2000 Pierce et al.
6,142,873 A 11/2000 Weiss et al.
6,142,874 A 11/2000 Kodachi et al.
6,146,273 A 11/2000 Olsen
6,152,448 A 11/2000 Cudlipp
6,155,925 A 12/2000 Giobbi et al.
6,159,095 A 12/2000 Frohm et al.
6,159,096 A 12/2000 Yoseloff
6,159,097 A 12/2000 Gura
6,159,098 A 12/2000 Slomiany et al.
6,165,070 A 12/2000 Nolte et al.

6,174,233 B1 1/2001 Sunaga et al.
6,174,235 B1 1/2001 Walker et al.
6,179,291 B1 1/2001 Vancura
6,186,894 B1 2/2001 Mayeroff
6,190,255 B1 2/2001 Thomas et al.
6,203,010 B1 3/2001 Jorasch et al.
6,209,869 B1 4/2001 Mathews
6,210,279 B1 4/2001 Dickinson
6,217,022 B1 4/2001 Astaneha
6,220,593 B1 4/2001 Pierce et al.
6,220,961 B1 4/2001 Keane et al.
6,224,482 B1 5/2001 Bennett
6,224,484 B1 5/2001 Okuda et al.
6,227,969 B1 5/2001 Yoseloff
6,231,442 B1 5/2001 Mayeroff
6,231,445 B1 5/2001 Acres
6,234,897 B1 5/2001 Frohm et al.
6,237,917 B1 5/2001 Timpano
6,238,288 B1 5/2001 Walker et al.
6,261,177 B1 7/2001 Bennett
6,267,669 B1 7/2001 Luciano, Jr. et al.
6,270,409 B1 8/2001 Shuster
6,270,412 B1 8/2001 Crawford et al.
6,293,866 B1 9/2001 Walker et al.
6,299,536 B1 10/2001 Hill
6,305,686 B1 10/2001 Perrie et al.
6,309,298 B1 10/2001 Gerow
6,309,299 B1 10/2001 Weiss
6,312,330 B1 11/2001 Jones et al.
6,312,334 B1 11/2001 Yoseloff
6,313,871 B1 11/2001 Schubert
6,334,814 B1 1/2002 Adams
6,336,859 B2 1/2002 Jones et al.
6,336,862 B1 1/2002 Byrne
6,345,824 B1 2/2002 Selitzky
6,346,044 B1 2/2002 McCrea, Jr.
6,347,996 B1 2/2002 Gilmore et al.
6,371,867 B1 4/2002 Webb
6,375,189 B1 4/2002 Jones
6,386,977 B1 5/2002 Hole
6,398,644 B1 6/2002 Perrie et al.
6,402,147 B1 6/2002 Lo
6,416,409 B1 7/2002 Jordan
6,419,583 B1 7/2002 Crumby et al.
6,425,823 B1 7/2002 Byrne
6,428,412 B1 8/2002 Anderson et al.
6,435,511 B1 8/2002 Vancura et al.
6,443,837 B1 9/2002 Jaffe et al.
6,460,848 B1 10/2002 Soltys et al.
6,461,240 B1 10/2002 Perkins
6,461,241 B1 10/2002 Webb et al.
6,464,582 B1 10/2002 Baerlocher et al.
6,471,591 B1 10/2002 Crumby
6,474,646 B1 11/2002 Webb
6,475,088 B1 11/2002 Jones et al.
6,481,713 B2 11/2002 Perrie et al.
6,482,089 B2 11/2002 Demar et al.
6,485,368 B2 11/2002 Jones et al.
6,497,409 B2 12/2002 Mathews
6,498,590 B1 12/2002 Dietz et al.
6,503,145 B1 1/2003 Webb
6,511,068 B1 1/2003 Sklansky et al.
6,514,140 B1 2/2003 Storch
6,517,073 B1 2/2003 Vancura
6,517,435 B2 2/2003 Soltys et al.
6,523,831 B2 2/2003 Webb
6,530,837 B2 3/2003 Soltys et al.
6,532,291 B1 3/2003 McGrath
6,533,276 B2 3/2003 Soltys et al.
6,533,658 B1 3/2003 Walker et al.
6,533,662 B2 3/2003 Soltys et al.
6,537,150 B1 3/2003 Luciano et al.
6,547,242 B1 4/2003 Sugiyama et al.
6,553,276 B2 4/2003 Akram et al.
6,558,255 B2 5/2003 Walker
6,569,015 B1 5/2003 Baerlocher et al.
6,572,471 B1 6/2003 Bennett
6,579,180 B2 6/2003 Soltys et al.
6,607,195 B2 8/2003 Vancura
6,609,711 B1 8/2003 Campbell
6,645,073 B2 11/2003 Lemay et al.
6,648,759 B2 11/2003 Vancura
6,652,378 B2 11/2003 Cannon et al.
6,656,040 B1 12/2003 Brosnan et al.
6,656,047 B1 12/2003 Tarantino et al.
6,659,462 B1 12/2003 Scott
6,666,766 B2 12/2003 Baerlocher et al.
6,672,975 B1 1/2004 Galloway
6,682,419 B2 1/2004 Webb et al.
6,682,420 B2 1/2004 Webb et al.
6,692,003 B2 2/2004 Potter et al.
6,692,355 B2 2/2004 Baerlocher et al.
6,702,289 B1 3/2004 Feola
6,705,944 B2 3/2004 Luciano
6,726,427 B2 4/2004 Jarvis et al.
6,726,563 B1 4/2004 Baerlocher et al.
6,726,565 B2 4/2004 Hughs-Baird
6,733,389 B2 5/2004 Webb et al.
6,733,390 B2 5/2004 Walker et al.
6,749,200 B2 6/2004 Yurkins
6,758,751 B2 7/2004 Soltys et al.
6,772,975 B2 8/2004 Sommerfeld et al.
6,776,415 B2 8/2004 Robinson et al.
6,789,800 B2 9/2004 Webb
6,802,773 B2 10/2004 Moody
6,808,173 B2 10/2004 Snow
6,827,348 B1 12/2004 Mitchell
6,840,517 B2 1/2005 Snow et al.
6,845,981 B1 1/2005 Ko
6,848,994 B1 2/2005 Knust et al.
6,857,958 B2 2/2005 Osawa
6,869,074 B2 3/2005 Miller
6,869,075 B1 3/2005 Stavinsky
6,869,359 B1 3/2005 Mathews
6,874,786 B2 4/2005 Bruno et al.
6,877,748 B1 4/2005 Patroni et al.
6,878,064 B2 4/2005 Huang
6,884,168 B2 4/2005 Wood et al.
6,890,255 B2 5/2005 Jarvis et al.
6,896,618 B2 5/2005 Benoy
6,896,620 B1 5/2005 Luciano et al.
6,902,167 B2 6/2005 Webb
6,921,333 B2 7/2005 Taguchi
6,923,446 B2 8/2005 Snow
6,932,703 B1 8/2005 Ritchie
6,938,900 B2 9/2005 Snow
6,988,731 B2 1/2006 Inoue
7,012,595 B2 3/2006 Lu
7,029,395 B1 4/2006 Baerlocher
7,030,861 B1 4/2006 Westerman et al.
7,094,150 B2 8/2006 Ungaro et al.
7,169,044 B2 1/2007 Baerlocher et al.
7,198,571 B2 4/2007 LeMay
7,204,428 B2 4/2007 Wilson
7,223,172 B2 5/2007 Baerlocher et al.
7,226,357 B2 6/2007 Vancura et al.
7,306,520 B2 12/2007 Kaminkow et al.
7,329,179 B2 2/2008 Baerlocher
7,331,868 B2 2/2008 Beaulieu et al.
7,351,146 B2 4/2008 Kaminkow
7,374,486 B2 5/2008 Baerlocher
7,397,464 B1 * 7/2008 Robbins et al. ..... 345/173
7,419,162 B2 9/2008 Lancaster et al.
7,463,270 B2 12/2008 Vale et al.
7,465,227 B2 12/2008 Baerlocher
7,470,185 B2 12/2008 Baerlocher
7,479,949 B2 1/2009 Jobs et al.
7,488,251 B2 2/2009 Kaminkow
2001/0000118 A1 4/2001 Sines et al.
2001/0000933 A1 5/2001 Koelling
2001/0035610 A1 11/2001 Webb
2001/0054796 A1 12/2001 Lo
2002/0028710 A1 3/2002 Ishihara et al.
2002/0034974 A1 3/2002 Wood et al.
2002/0042298 A1 4/2002 Soltys et al.
2002/0042299 A1 4/2002 Soltys et al.
2002/0045472 A1 4/2002 Adams
2002/0068625 A1 6/2002 Soltys et al.

2002/0072405 A1 6/2002 Soltys et al.
2002/0072407 A1 6/2002 Soltys et al.
2002/0077167 A1 6/2002 Merari
2002/0077170 A1 6/2002 Johnson et al.
2002/0094855 A1 7/2002 Berman
2002/0119824 A1 8/2002 Allen
2002/0140680 A1 10/2002 Lu
2002/0169017 A1 11/2002 Visoenik
2002/0177480 A1 11/2002 Rowe
2002/0185981 A1 12/2002 Dietz et al.
2002/0198036 A1 12/2002 Baerlocher et al.
2003/0004871 A1* 1/2003 Rowe ..... 705/39
2003/0020733 A1 1/2003 Yin
2003/0057648 A1 3/2003 Webb
2003/0064772 A1 4/2003 Tempest et al.
2003/0064785 A1 4/2003 Stone et al.
2003/0069064 A1 4/2003 Ainsworth
2003/0071418 A1 4/2003 Saucier
2003/0087696 A1 5/2003 Soltys et al.
2003/0094752 A1 5/2003 Mathews
2003/0104862 A1 6/2003 Acres
2003/0144053 A1 7/2003 Michaelson
2003/0151194 A1 8/2003 Hessing et al.
2003/0171142 A1 9/2003 Kaji et al.
2003/0181231 A1 9/2003 Vancura et al.
2003/0207709 A1 11/2003 Paotrakul
2003/0207710 A1 11/2003 Rodgers et al.
2003/0211884 A1 11/2003 Gauselmann
2003/0236116 A1 12/2003 Marks et al.
2004/0029631 A1 2/2004 Duhamel
2004/0053661 A1 3/2004 Jones et al.
2004/0053673 A1 3/2004 Mishra
2004/0053683 A1 3/2004 Hartl et al.
2004/0063492 A1 4/2004 Baerlocher et al.
2004/0070146 A1 4/2004 Snow
2004/0072619 A1 4/2004 Brosnan et al.
2004/0127284 A1 7/2004 Walker et al.
2004/0152509 A1 8/2004 Hornik et al.
2004/0164491 A1 8/2004 Webb
2004/0171416 A1 9/2004 Baerlocher et al.
2004/0183256 A1 9/2004 Ko
2004/0195770 A1 10/2004 Ornstein
2004/0204218 A1 10/2004 Hughs-Baird
2004/0224777 A1 11/2004 Smith et al.
2004/0251630 A1 12/2004 Sines et al.
2005/0009600 A1 1/2005 Rowe et al.
2005/0012273 A1 1/2005 Bruno et al.
2005/0026680 A1 2/2005 Gururajan
2005/0026683 A1 2/2005 Fujimoto
2005/0029743 A1 2/2005 Daines
2005/0032568 A1 2/2005 Griswold et al.
2005/0051963 A1 3/2005 Snow
2005/0054408 A1 3/2005 Steil et al.
2005/0054429 A1 3/2005 Baerlocher et al.
2005/0059461 A1 3/2005 Ching et al.
2005/0060050 A1 3/2005 Baerlocher
2005/0073100 A1 4/2005 Falciglia, Sr.
2005/0073102 A1 4/2005 Yoseloff et al.
2005/0082758 A1 4/2005 Sklansky et al.
2005/0101374 A1 5/2005 Acres
2005/0116414 A1 6/2005 Yurkins
2005/0119043 A1 6/2005 Berman et al.
2005/0119047 A1 6/2005 Olive
2005/0119048 A1 6/2005 Soltys et al.
2005/0143168 A1 6/2005 Torango
2005/0161882 A1 7/2005 Miller
2005/0162402 A1 7/2005 Watanachote
2005/0164759 A1 7/2005 Smith et al.
2005/0164760 A1 7/2005 Moody
2005/0176488 A1 8/2005 Olive
2005/0178074 A1 8/2005 Kerosetz
2005/0209004 A1 9/2005 Torango
2005/0215307 A1 9/2005 Jarvis et al.
2005/0227771 A1 10/2005 Nelson
2005/0239542 A1 10/2005 Olsen
2005/0245302 A1* 11/2005 Bathiche et al. ..... 463/1
2005/0251800 A1* 11/2005 Kurlander et al. ..... 717/174
2005/0269776 A1 12/2005 Miller
2005/0282622 A1 12/2005 Lindquist
2005/0282625 A1 12/2005 Nicely
2005/0282626 A1* 12/2005 Manfredi et al. ..... 463/25
2006/0001211 A1 1/2006 Lewis et al.
2006/0019739 A1 1/2006 Soltys et al.
2006/0022956 A1 2/2006 Lengeling et al.
2006/0026521 A1 2/2006 Hotelling et al.
2006/0030394 A1 2/2006 Crivelli et al.
2006/0030959 A1 2/2006 Duhamel
2006/0030960 A1 2/2006 Duhamel et al.
2006/0032680 A1 2/2006 Elias et al.
2006/0046821 A1 3/2006 Kaminkow et al.
2006/0046849 A1 3/2006 Kovacs et al.
2006/0052885 A1 3/2006 Kong
2006/0058088 A1 3/2006 Crawford et al.
2006/0066564 A1 3/2006 Yee et al.
2006/0068864 A1 3/2006 White et al.
2006/0068870 A1 3/2006 Crawford et al.
2006/0086896 A1 4/2006 Han
2006/0097991 A1 5/2006 Hotelling et al.
2006/0125803 A1 6/2006 Westerman et al.
2006/0128457 A1 6/2006 Cannon
2006/0135238 A1 6/2006 Lancaster et al.
2006/0148565 A1 7/2006 Gauselmann et al.
2006/0157928 A1 7/2006 O'Halloran
2006/0170154 A1 8/2006 Matsuno et al.
2006/0170155 A1 8/2006 Silverman
2006/0197750 A1 9/2006 Kerr et al.
2006/0197753 A1 9/2006 Hotelling
2006/0237905 A1 10/2006 Nicely et al.
2006/0238517 A1 10/2006 King et al.
2006/0238518 A1 10/2006 Westerman et al.
2006/0238519 A1 10/2006 Westerman et al.
2006/0238520 A1 10/2006 Westerman et al.
2006/0238521 A1 10/2006 Westerman et al.
2006/0238522 A1 10/2006 Westerman et al.
2006/0240887 A1 10/2006 Walker et al.
2006/0249899 A1 11/2006 Lease
2006/0284874 A1 12/2006 Wilson
2006/0287053 A1 12/2006 Yokota
2007/0021198 A1 1/2007 Muir
2007/0045958 A1 3/2007 Rader et al.
2007/0054726 A1 3/2007 Muir et al.
2007/0069459 A1 3/2007 Guindulain Vidondo
2007/0070050 A1 3/2007 Westerman et al.
2007/0070051 A1 3/2007 Westerman et al.
2007/0070052 A1 3/2007 Westerman et al.
2007/0075488 A1 4/2007 Pececnik
2007/0078919 A1 4/2007 Westerman et al.
2007/0081726 A1 4/2007 Westerman et al.
2007/0120320 A1 5/2007 Miltenberger et al.
2007/0135203 A1 6/2007 Nicely
2007/0135204 A1 6/2007 Nicely
2007/0139395 A1 6/2007 Westerman et al.
2007/0146336 A1 6/2007 Ording et al.
2007/0152980 A1 7/2007 Kociendae et al.
2007/0152984 A1 7/2007 Ording et al.
2007/0155464 A1 7/2007 Baerlocher
2007/0155481 A1 7/2007 Vancura
2007/0157089 A1 7/2007 Van Os et al.
2007/0167229 A1 7/2007 LeMay et al.
2007/0177803 A1 8/2007 Elias et al.
2007/0177804 A1 8/2007 Elias et al.
2007/0188444 A1 8/2007 Vale et al.
2007/0192550 A1 8/2007 Rodeheffer et al.
2007/0213119 A1 9/2007 Baerlocher et al.
2008/0020815 A1 1/2008 Lancaster et al.
2008/0070674 A1 3/2008 Lancaster et al.
2008/0076500 A1 3/2008 Lancaster et al.
2008/0076581 A1 3/2008 Mattice et al.
2008/0102934 A1 5/2008 Tan
2008/0108406 A1 5/2008 Oberberger
2008/0108425 A1 5/2008 Oberberger
2008/0113759 A1 5/2008 Baerlocher
2008/0122803 A1 5/2008 Izadi et al.
2008/0132320 A1 6/2008 Rodgers
2008/0182650 A1 7/2008 Randall et al.
2008/0182655 A1 7/2008 DeWaal et al.
2008/0194316 A1 8/2008 Baerlocher
2008/0214280 A1 9/2008 Baerlocher

| | | | | |
|---|---|---|---|---|
| 2008/0318668 | A1 | 12/2008 | Ching et al. | |
| 2009/0117994 | A1 | 5/2009 | Kelly et al. | |
| 2009/0118005 | A1* | 5/2009 | Kelly et al. | 463/31 |
| 2009/0124379 | A1 | 5/2009 | Wells | |
| 2009/0124383 | A1 | 5/2009 | Gadda et al. | |
| 2009/0143141 | A1 | 6/2009 | Wells et al. | |
| 2009/0325686 | A1 | 12/2009 | Davis et al. | |
| 2010/0087241 | A1 | 4/2010 | Nguyen et al. | |
| 2010/0130280 | A1* | 5/2010 | Arezina et al. | 463/20 |
| 2011/0065513 | A1 | 3/2011 | Nordahl et al. | |

FOREIGN PATENT DOCUMENTS

| | | | |
|---|---|---|---|
| EP | 0 945 837 | | 9/1999 |
| EP | 0956111 | | 11/1999 |
| EP | 0 984 408 | | 3/2000 |
| EP | 0 984 409 | | 3/2000 |
| EP | 1226851 | | 7/2002 |
| EP | 1 469 432 | | 4/2004 |
| EP | 1 671 684 | | 6/2006 |
| EP | 1 710 000 | | 10/2006 |
| EP | 1 721 642 | | 11/2006 |
| EP | 1 736 215 | | 12/2006 |
| EP | 1769828 | | 4/2007 |
| GB | 2 096 376 | A | 10/1982 |
| GB | 2 097 160 | A | 10/1982 |
| GB | 2 100 905 | A | 1/1983 |
| GB | 2 117 952 | | 10/1983 |
| GB | 2 137 392 | A | 10/1984 |
| GB | 2 142 457 | A | 1/1985 |
| GB | 2 153 572 | A | 8/1985 |
| GB | 2 161 008 | A | 1/1986 |
| GB | 2 161 009 | A | 1/1986 |
| GB | 2 170 636 | A | 8/1986 |
| GB | 2 180 682 | A | 4/1987 |
| GB | 2 181 589 | A | 4/1987 |
| GB | 2 183 882 | A | 6/1987 |
| GB | 2 191 030 | | 12/1987 |
| GB | 2 222 712 | A | 3/1990 |
| GB | 2 226 907 | A | 7/1990 |
| GB | 2 358 591 | | 8/2001 |
| GB | 2 395 139 | | 5/2004 |
| GB | 2 408 951 | | 6/2005 |
| GB | 2 431 362 | | 4/2007 |
| JP | 2005-211384 | A | 8/2005 |
| WO | WO 97/38366 | | 10/1997 |
| WO | WO 97/38766 | | 10/1997 |
| WO | WO 98/47115 | | 10/1998 |
| WO | WO 98/51384 | | 11/1998 |
| WO | WO 00/12186 | | 5/2000 |
| WO | WO 00/33269 | | 6/2000 |
| WO | WO 03/013673 | | 2/2003 |
| WO | WO 03/025867 | | 3/2003 |
| WO | WO 03/026381 | | 4/2003 |
| WO | WO 2004/021294 | | 3/2004 |
| WO | WO 2004/112923 | | 12/2004 |
| WO | WO 2005/009563 | | 2/2005 |
| WO | WO 2005/025696 | | 3/2005 |
| WO | WO 2005/025701 | | 3/2005 |
| WO | WO 2005/037385 | | 4/2005 |
| WO | WO 2005/081958 | | 9/2005 |
| WO | WO 2005/083599 | A1 | 9/2005 |
| WO | WO 2005/099425 | A2 | 10/2005 |
| WO | WO 2005/123203 | | 12/2005 |
| WO | WO 2006/015442 | | 2/2006 |
| WO | WO 2006/061616 | | 6/2006 |
| WO | WO 2006/078219 | | 7/2006 |
| WO | WO 2006/094398 | | 9/2006 |
| WO | WO 2006/097007 | | 9/2006 |
| WO | WO 2007/024202 | | 3/2007 |
| WO | WO 2007/033430 | | 3/2007 |
| WO | WO 2007/075380 | | 7/2007 |
| WO | WO 2007/077449 | | 7/2007 |
| WO | WO 2008/045464 | | 4/2008 |

OTHER PUBLICATIONS

U.S. Appl. No. 11/557,843, filed Nov. 8, 2006, Baerlocher.
U.S. Appl. No. 11/853,952, filed Sep. 28, 2007, Gerrard, et al.
U.S. Appl. No. 11/864,439, filed Sep. 28, 2007, Oberberger et al.
U.S. Appl. No. 11/873,948, filed Oct. 17, 2007, Zielinski.
U.S. Appl. No. 11/924,396, filed Oct. 25, 2007, Iddings.
U.S. Appl. No. 12/102,308, filed Apr. 14, 2008, Baerlocher.
Plinko description of Price is Right game from 1983, at http://gscentral.net/plinko.htm.
A Day on the Surface: A Hands-On Look at Microsoft's New Computing Platform from http://arstechnica.com/microsoft/news/2007/09/surface.ars/2 on article printed Jan. 27, 2009.
The Price is Right Video Slots advertisement Featuring Plinko published by IGT.
Multi-touch, Surface Computing, iPhone, and more . . . article printed from Just Good Design on Nov. 6, 2008.
Multitouch Interface Is Starting to Spread Among New Devices article printed in the Wall Street Journal on Jan. 31, 2008.
Advantage Casino System Bonusing Brochure, written by IGT, available prior to Aug. 30, 2005.
Advantage Casino System Brochure, Mobile Data Access, written by IGT, available prior to Aug. 30, 2005.
Advantage Casino System Brochure, NexGen Interactive Touch Screen Display, written by IGT, available prior to Aug. 30, 2005.
Advantage Casino System Marketing Brochure, written by IGT, available prior to Aug. 30, 2005.
Advantage Casino System Table Touch Brochure, written by IGT, 2004.
Bingo Game Brochure written by Casino Data System/published in 1998.
The Coffee Table that will Change the World, article printed in Popular Mechanics Magazine in Jul. 2007.
Description of Poker written by Hoyle's Rules of Games published 1946-1983.
Fortune Cookie Brochure written by IGT/published in 2000.
Full House Brochure written by Anchor Games/published in 2000.
Jackpot Bingo written by CDS.com/printed Apr. 12, 2001.
Jewel in the Crown Brochure written by Barcrest/Ltd/ available prior to Aug. 30, 2005.
Match Reel Game Bonus Description written by IGT/ available prior to Aug. 30, 2005.
Mikohn Ripley's Believe It or Not Article written by Strictly Slots published in 2001.
Payday Poker Article written by Bally Gaming Systems/published in 2005.
Plinko Showcase Show Down written by International Game Technology/published in 2001.
Take Your Pick Brochure and Article written by IGT/Anchor Games, Strictly Slots, published in 1999.
Tetris Game Description written by Radica/published in 2000.
Top Dollar Brochure written by IGT published in 1998.
The Shape of Computers to Come article published on the Wall Street Journal Website on May 30, 2007.
Letter from Marvin A. Motsenbocker of Mots Law dated Nov. 29, 2011 regarding Third Party Submission in Published Application Under 37 C.F.R. 1.99 filed for U.S. Appl. No. 13/152,786 (1 page).
Third Party Submission in Published Application Under 37 C.F.R. 1.99 filed for U.S. Appl. No. 13/152,786, dated Nov. 29, 2011 (3 pages).
Partially highlighted U.S. Patent No. 6,921,333 submitted with Third Party Submission in Published Application Under 37 C.F.R. 1.99 for U.S. Appl. No. 13/152,786 (2 pages).
Partially highlighted JP 2005-211384A and English translation of paragraph [0022] of same submitted with Third Party Submission in Published Application Under 37 C.F.R. 1.99 for U.S. Patent Application No. 13/152,786 (3 pages).
Office Action for U.S. Appl. No. 13/152,786 dated Feb. 2, 2012 (9 pages).
Office Action for U.S. Appl. No. 13/152,796 dated Feb. 2, 2012 (6 pages).
Office Action for U.S. Appl. No. 13/152,814 dated Dec. 12, 2011 (7 pages).

* cited by examiner

GAMING SYSTEM HAVING USER INTERFACE WITH UPLOADING AND DOWNLOADING CAPABILITY

PRIORITY

This application is a non-provisional of, claims the benefit of and priority to U.S. Provisional Application No. 60/986,858, filed Nov. 9, 2007, the entire contents of which is incorporated herein by reference.

CROSS REFERENCE TO RELATED APPLICATIONS

This application relates to the following co-pending commonly owned applications: "GAMING SYSTEM HAVING A DISPLAY/INPUT DEVICE CONFIGURED TO INTERACTIVELY OPERATE WITH EXTERNAL DEVICE," Ser. No. 12/267,120; "GAMING SYSTEM HAVING MULTIPLE PLAYER SIMULTANEOUS DISPLAY/INPUT DEVICE," application Ser. No. 13/152,786; "GAMING SYSTEM HAVING MULTIPLE PLAYER SIMULTANEOUS DISPLAY/INPUT DEVICE," application Ser. No. 13/152,796; and "GAMING SYSTEM HAVING MULTIPLE PLAYER SIMULTANEOUS DISPLAY/INPUT DEVICE," application Ser. No. 13/152,814.

BACKGROUND

Known proposed wagering game tables are not able to create a sufficiently real life table gaming experience in which multiple players playing at a same gaming area and share game play and other experiences. While proposed wagering game tables offer certain advantages in terms of game flexibility and heightened graphics, proposed game tables separate the players from one another using individual gaming devices or individual display screens (with separate touch screens or other input devices) for each player. One primary reason for this is that these separate player stations enable each of the players to make inputs (using their own separate touch screen or other input devices) at the same time or at nearly the same time. While certain game tables using so-called multi-touch systems have been proposed, these game tables do not fully provide a real life table gaming experience for multiple players.

Accordingly, a need exists for improved gaming systems that enables multiple players to simultaneously play shared integrated games more interactively and which provide a more real life table gaming experience.

SUMMARY

Various embodiments of the gaming system of the present disclosure provide a game table having a multiplayer interactive display/input device which enables multiple players to simultaneously play primary or base wagering games and/or secondary or bonus games. The display/input device enables multiple players to simultaneously interact with the gaming system, the game table and the various games using a common or the same display/input device. For example, the game table enables multiple players to manipulate displayed objects (such as cards or other game symbols) displayed by the display/input device at the same time. That is, the display/input device of the game table is configured to accept multiple inputs (such as touch inputs) from multiple players simultaneously. This enables the display/input device to simultaneously display the same game to multiple players in an integrated seamless manner without the need for multiple different sets of display devices and input devices for each player as in numerous previously proposed game tables. Thus, in the preferred embodiment, the game table has a single multiplayer display/input device which all of the players use to play the game(s).

The display/input device in various embodiments is additionally configured to sense actions or movements made close to the surface of the display/input device. Thus, for example, in certain embodiments, the display/input device can discern between (a) the waving of a players hand back and forth relative to the display/input device as one type of input by the player, and (b) a vertical movement of the player's hand up and down relative to the display/input device as a different type of input by the player. In various embodiments, the display/input device is configured to do this for multiple players at the same time.

Additionally, in various embodiments, the display/input device of the game table is configured to interact with one or more external objects such as external physical input devices (besides a player's hand) as described below.

These abilities to display multiple game functions and game symbols to multiple players at the same time on one display/input device, to receive multiple inputs from multiple players at the same time through the one display/input device, and to interact with external objects provides for seamless integrated game play much more like a live game table while providing the security and other advantages of an automated gaming system. This also provides for additional game play functionality and additional player interaction functionality as further discussed below in accordance with the present invention.

More specifically, one suitable table for the gaming system of the present disclosure is provided by Microsoft Corporation, Redmond, Wash., which uses a technology described in at least U.S. Pat. No. 7,204,428, the entire contents of which are incorporated herein by reference. This table is configured to simultaneously sense touches of multiple people and is also configured to sense coded patterns such as coded patterns applied to objects above the display/input surface of the table. This table is configured to identify the inputs by people and the objects when placed on the surface of the display/input device. This table is also configured to sense movements within a predefined distance above the table. In various embodiments, the game table of the present disclosure includes a plurality of infrared ("IR") video cameras on an opposite side of the display surface from the person or object. In various embodiments, one or more of the cameras are configured to detect reflected infrared ("IR") light received from or reflected by the person or a coded pattern printed on or attached to the object. In various embodiments, the coded pattern is an identifier of the object as further discussed below. It should be appreciated that, as further described below, the coded pattern is passive in that the coded pattern does not send any electronic signal to the game table, but is rather identified by the game table.

The present disclosure contemplates using such game tables for displaying game symbols (such as cards, dice, etc.) and displaying game functions (such as bets required, outcomes and awards) to one or more players and for enabling one or more players and/or live dealers to simultaneously and/or sequentially interact with the game tables using their hands, or using other physical objects (such as playing cards, dice, or wagering chips) or other suitable input devices.

In one example embodiment, the one display/input device display virtual cards for and the virtual chips of each of a plurality of players. The cameras operate with the displayed cards and displayed chips to sense when the displayed cards and the displayed chips are touched or moved by a player or dealer to accomplish a function in or related to a game. The processing and memory controlling the game table are configured for this purpose. For example, the processing and memory are configured to enable a card to be touched by a live dealer, who slides the displayed card from a position in front of the dealer to a position in front of the player such that it can be thereafter handled (such as moved or otherwise manipulated according to game rules) by the player. The processing and memory thereafter enable the player to manipulate the card in accordance with the game rules. Alternatively, the processing and memory are configured to provide a virtual dealer who deals the cards to the players. This facilitates game play in an integrated seamless manner between the dealer and all of the players in part because the cards and chips are seamlessly shown or displayed moving between the dealer and players without any interruption similar to a live game table.

In an example blackjack game embodiment, players take turns as the live dealer or virtual dealer moves across the game table. In one embodiment, the gaming system is programmed to move from player to player, making the current indicated player the active player and ignoring or disallowing certain or all actions taken by other players. Thus, a player who is not active at a point in time can try to make an input such as a "hit" or "stay" movement without actually inputting a decision (which causes an action) into the gaming system. In other words, at designated times, the gaming system only recognizes inputs by one designated player and can ignore inputs by the other players. The display/input device in one embodiment indicates or highlights the active player (such as by brightening or enlarging that active player's cards, while dulling non-active cards). This indicating or highlighting lets each player playing at the game table know which player is the currently active player (i.e., the player whose turn it is), which player has just made a gaming decision, and which player is up next. This example embodiment shows how the game table enables the players to take turns making inputs through the same display/input device. It should be appreciated that the game table can also be configured to alternatively enable the two or more of the players to make such inputs simultaneously, and that a better gaming experience is provided with a single display/input device that displays all of the desired game functional elements to the players and enables the players to make such inputs through the same display/input device.

It should be appreciated that the game table can in various embodiments be used in different gaming modes such as primary game modes, secondary game modes, and promotional modes. In certain modes, it is contemplated to provide the player with a card that is encoded or encrypted with a tag (such as an radio frequency tag) that the cameras or readers of the game table can detect. In various such embodiments, the tag identifies the player game and enables the gaming system to determine any suitable desired player information such as player tracking information, and whether the player has for example been given a promotion from the casino to play a promotional game at the game table. It should be appreciated that the card can be generic or can be personalized for a specific player. The card in one embodiment is clear or transparent and in an alternative embodiment translucent or otherwise see through. When such a card is placed on the game table and specifically display/input device of the game table, the gaming system reads the tag encoded on the card, identifies the player and the promotional game and displays the game. In one embodiment, the game is displayed around or adjacent to the card. That is, the display/input device senses where the card is located, senses or knows the dimensions of the card and displays the game around or adjacent to the card and/or underneath the card.

The player enters information by touching the card or the display input device around or adjacent to the card. The game in one example embodiment has a safecracker theme. In this example embodiment, the display/input device displays a plurality of numbers either beneath the card, around or adjacent to the card, or both. Because the card is transparent in one embodiment, the player can see any selections displayed beneath the card. The display/input device enables the player to pick numbers, such as four of six numbers. In one example embodiment, two of the six numbers are needed to open the safe. If the player picks the two needed numbers within the player's four picks, the player receives an award such as the safecracker prize or award. In one embodiment, the prize or award is for example shown moving across the game table towards a ticket printer. When nearing the ticket printer, the display/input device shows the prize being sucked into the game table towards the ticket printer, after which the ticket printer prints a ticket having the prize or award encoded on the ticket. It should thus be appreciated that the card interacts wirelessly with the game table (and specifically the display/input device) as a separate physical player input device. It should also be appreciated that other suitable devices besides cards can interact wirelessly with the game table (and specifically the display/input device) as a separate player input device.

In various other embodiments, the game table can also output information wirelessly using the radio frequency cameras or other transmitters to a separate player's device having wireless capability. For example, if the player wins a prize or award and the display/input device displays a player win screen from a play of a game that the player wishes to upload to the player personal digital assistant ("PDA"), the display/input device enables the player to do so. In other embodiments, the gaming system can enable the player to create custom frames to save relating to the player's game play. For instance, the gaming system enables the player to save customized frames with the player's name, time, casino, or other suitable information. For example, if the player hits a royal straight flush playing poker, the player may want to save the image of that win. It should also be appreciated that the ability to do so may be only upon occurrence of one or more designated triggering events or a suitable size award to create a memory and capture the moment for uploading.

More specifically, for example, the player can set their PDA (such as a cell phone, digital music player, or other such device) onto the game table (and specifically on the display/input device) and press an upload input displayed by the display/input device to cause such uploading. The player win screen is thereafter stored on the player's PDA and can be recalled and viewed as desired or alternatively sent such as via a system server in communication with the game table to the player's desired destination such as a designated email address. It should also be appreciated that the display/input device can cause a game to be displayed around or adjacent to the PDA of the player similar to the card example discussed above.

In various embodiments, the player can also upload sounds from the game table. For example, the player can upload the sounds of a slot game play or payout or other play or payout (e.g., the ding, ding, ding, ding) sound to the player's PDA such as a cell phone to use as a ring tone or in other suitable manner. In one such embodiment, the player sets the wireless device or other device on the game table (and specifically on the display/input device) and presses a displayed sound generation input on display/input device. Alternatively, the player may press an upload input button, gesture, or have the game table recognize the object because it has been tagged (as discussed below) and start the upload automatically. The cell phone or other device receives the song in digital form, which can thereafter be played on the phone or other suitable device.

It should be appreciated that various suitable communication methods and protocols can be employed for the transfer. In one embodiment, the widely used BLUETOOTH™ protocol is employed to establish communications, identify the device(s), and facilitate communication back and forth with the game table or gaming system.

It is therefore an advantage of the present disclosure to provide a gaming system having a display/input device that is configured to communicate with separate player devices.

Another advantage of the present disclosure is to provide a gaming system having a display/input device, and which is programmed to upload information to a separate player device.

Another advantage of the present disclosure is to provide a gaming system having a display/input device, and which is programmed to download information from a separate player device.

Another advantage of the present disclosure is to provide a gaming system having a display/input device, and that is programmed to enable the player to customize a display or a portion thereof of the display/input device for game play.

Another advantage of the present disclosure is to provide a gaming system having a display/input device, and which is programmed to enable game play via a separate player card.

Another advantage of the present disclosure is to provide a gaming system having a display/input device that displays a game underneath, adjacent to, and/or around an object placed on the display/input device.

Additional features and advantages are described herein, and will be apparent from, the following Detailed Description and the figures.

DETAILED DESCRIPTION

Figure 1:
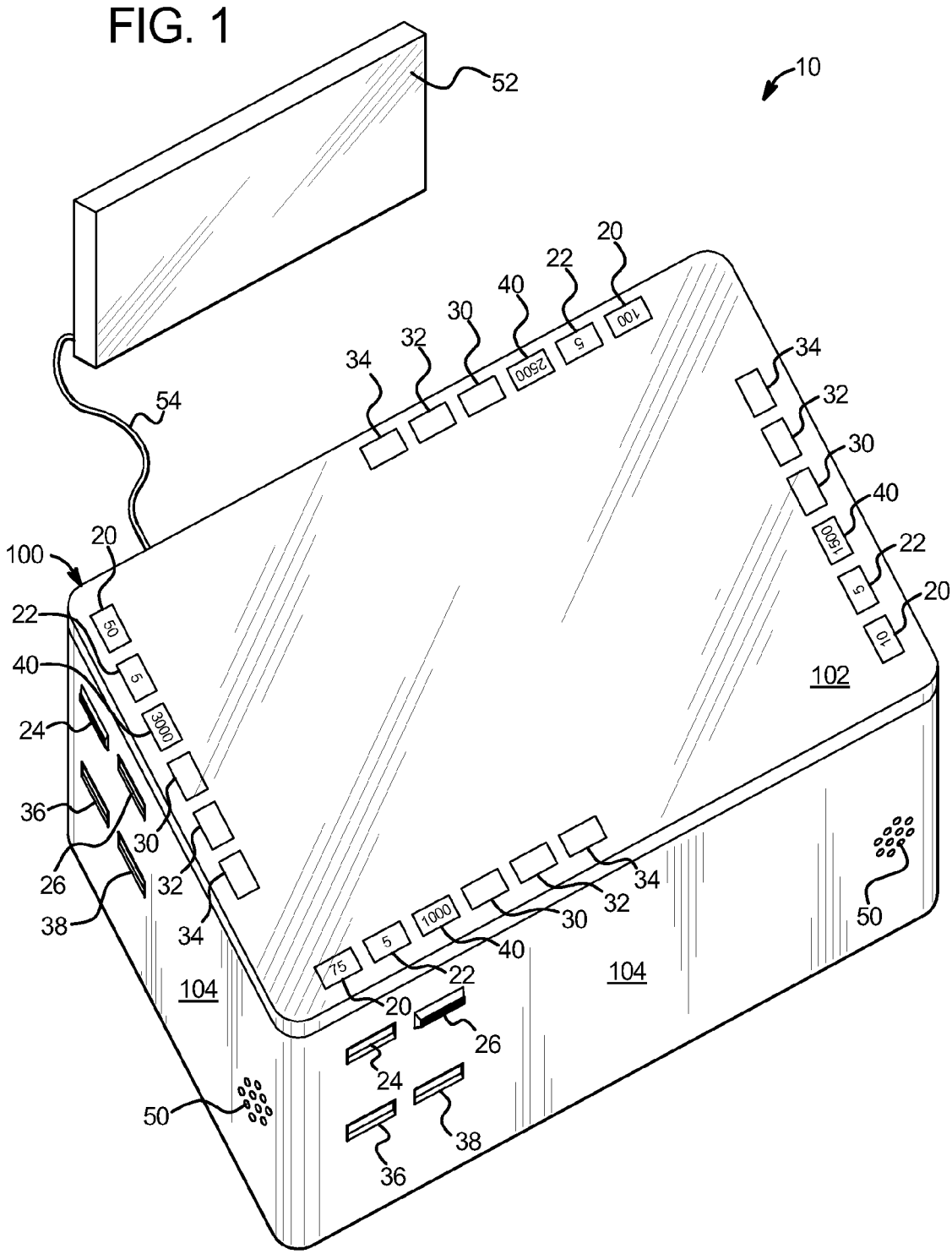
FIG. 1 is a perspective view of one embodiment of a gaming system having the multiple player simultaneous display/input device game table of the present disclosure.

Referring now to the drawings, gaming system 10 as shown in FIG. 1 is one embodiment a multiple player simultaneous display/input device gaming system of the present disclosure. Gaming system 10 may be implemented in various configurations including but not limited to: (1) a dedicated gaming system in which the computerized instructions for controlling any games (which are provided by the gaming system) are provided with the gaming system prior to delivery to a gaming establishment; and (2) a changeable gaming system in which the computerized instructions for controlling any games (which are provided by the gaming system) are downloadable to the gaming system through a data network after the gaming system is installed at a gaming establishment.

In one embodiment, the computerized instructions for controlling any games are executed by at least one central server, central controller, or remote host. In such a "thin client" embodiment, the central server remotely controls any games (or other suitable interfaces), and gaming system is utilized to display such games (or suitable interfaces) and receive one or more inputs or commands from one or more players.

In another embodiment, the computerized instructions for controlling any games are communicated from the central server, central controller, or remote host to a gaming system local processing and memory. In such a "thick client" embodiment, gaming system local processing executes the communicated computerized instructions to control any games (or other suitable interfaces) provided to a player.

In one embodiment, one or more gaming systems in a network of multiple gaming systems may be a thin client gaming system and one or more gaming system in the network may be a thick client gaming system. In another embodiment, certain functions of gaming system are implemented in a thin client environment and certain other functions of gaming system are implemented in a thick client environment. In one such embodiment, computerized instructions for controlling any primary games are communicated from the central server to gaming system in a thick client configuration and computerized instructions for controlling any secondary games or bonus functions are executed by a central server in a thin client configuration.

The gaming system 10 includes a game table having a support structure, housing, or cabinet, which provides support for a multi-touch display/input device and other features needed for a gaming machine. It is configured so that a player can operate it while standing or sitting. It should be appreciated that the game table can be configured in other suitable manners.

Figure 2A:
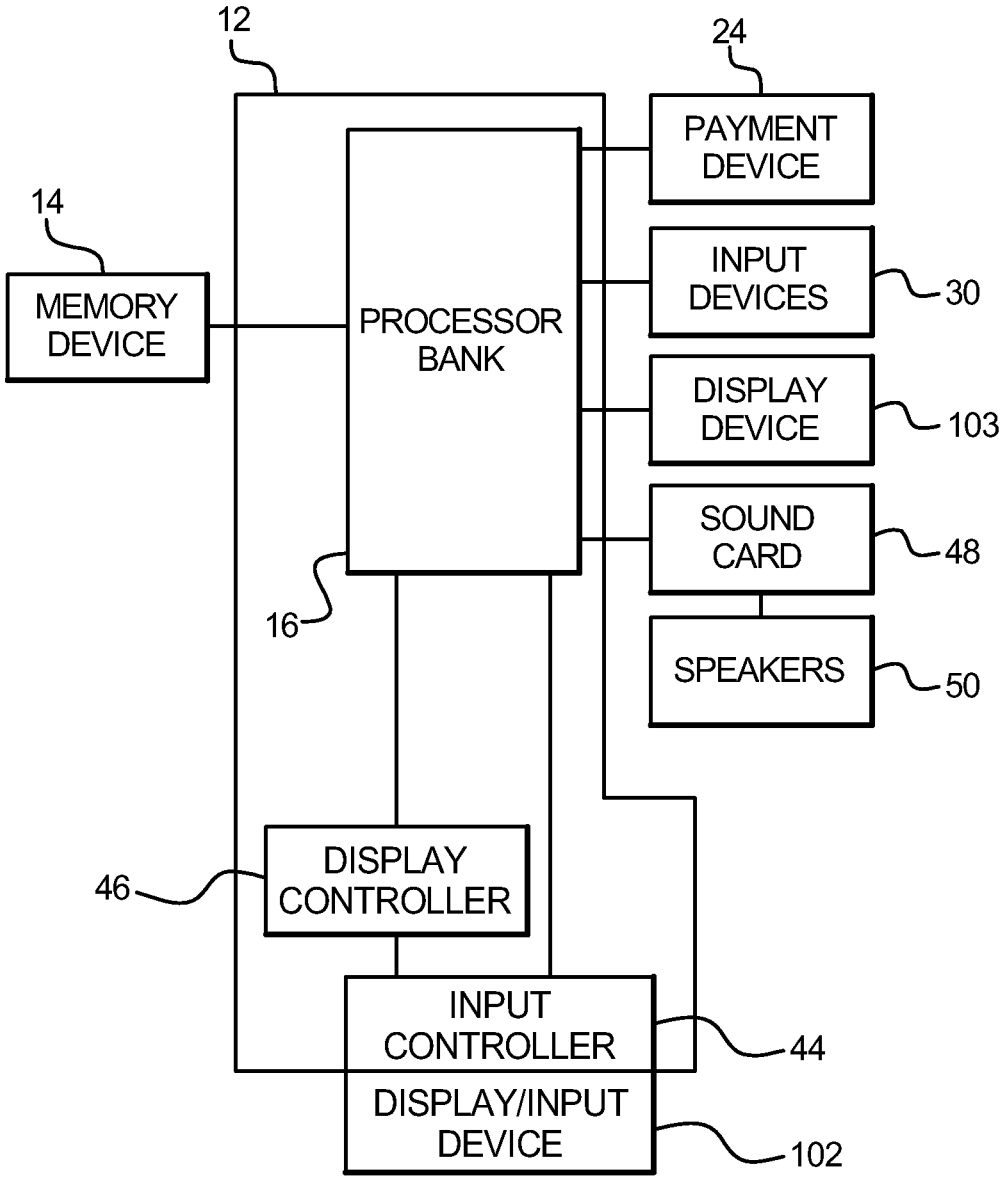
FIG. 2A is a schematic view of one embodiment for an electrical configuration for the multiple player simultaneous display/input device game table of the present disclosure.

As seen additionally in FIG. 2A, gaming system 10 includes a plurality of processors or processor bank 16, which can for example include a primary processor in communication with a plurality of delegate processors. For purposes of this description, "processing 12" refers to the entire processing apparatus and functioning, including the multiple individual processors of bank 16. The individual processors can be any suitable combination of microprocessors, integrated circuits or application-specific integrated circuits ("ASIC's"). Processing 12 is in communication with or operable to access or to exchange signals with at least one data storage or memory device. For purposes of this description, "memory 14" refers to the entire memory or storage apparatus and its functioning, including multiple individual memory devices. In one embodiment, processing 12 and memory 14 reside within a multiple player game table 100 that enables multiple players to input information simultaneously into gaming system 10.

Memory 14 stores program code and instructions, executable by processing 12, to control gaming system 10. Memory 14 also stores other data such as image data, event data, player input data, random or pseudo-random number generators, physics engine, pay-table data or information, and applicable game rules that relate to the play of gaming system 10. In one embodiment, memory 14 includes any one or more of random access memory ("RAM"), which can include non-volatile RAM ("NVRAM"), magnetic RAM ("MRAM"), ferroelectric RAM ("FeRAM"), and other forms as commonly understood in the gaming industry, read only memory ("ROM"), flash memory and/or electrically erasable programmable read only memory ("EEPROM").

In one embodiment, part or all of the program code and/or operating data described above can be stored in a detachable or removable memory device, including, but not limited to, a suitable cartridge, disk, compact disk ("CD") ROM, digital video disk ("DVD"), or universal serial port ("USB") memory device. In other embodiments, part or all of the program code and/or operating data described above can be downloaded to memory 14 through a network.

In one embodiment, gaming system 10 is operable over a wireless network, for example as part of a wireless gaming system. It should be appreciated that a gaming system may be a device that has obtained approval from a regulatory gaming commission or a device that has not obtained approval from a regulatory gaming commission.

In various embodiments, gaming system 10 randomly generates awards and/or other game outcomes based on probability data. In one such embodiment, this random determination is made via a random number generator ("RNG"), such as a true random number generator, a pseudo random number generator, physics engine, or other suitable randomization process. In one embodiment, each award or other game outcome is associated with a probability, wherein gaming system 10 generates the award or other game outcome to be provided to the player based on the associated probabilities. Here, since gaming system 10 generates outcomes randomly or based upon one or more probability calculation, there is no certainty that gaming system 10 will ever provide the player with any specific award or other game outcome.

In another embodiment, as discussed in more detail below, gaming system 10 employs a predetermined or finite set or pool of awards or other game outcomes. Here, as each award or other game outcome is provided to the player, gaming system 10 flags or removes the provided award or other game outcome from the predetermined set or pool. Once flagged or removed from the set or pool, the specific provided award or other game outcome from that specific pool cannot be provided to the player again. This type of gaming system provides players with all of the available awards or other game outcomes over the course of the play cycle and guarantees the amount of actual wins and losses.

One suitable table for gaming system 10 of the present disclosure is provided by Microsoft Corporation, Redmond, Wash., which uses a technology descried in U.S. Pat. No. 7,204,428 ("the '428 patent). This so-called surface computing technology employs an acrylic top and a plurality of infrared cameras and a DLP projector with Wi-FI™ and BLUETOOTH™ wireless networks to display and detect objects and movement. As players move their hands or objects on or above the table top, the cameras translate the motions into commands. BLUETOOTH is a trademark of Bluetooth SIG, Inc. In certain embodiments, the technology includes the application of a coded pattern applied to an external object. The interactive display/input device identifies the object when it is on the surface of display/input device 102 of the game table 100. More specifically, gaming system 10 includes a plurality of infrared ("IR") video cameras located beneath surface of display/input device 102, on an opposite side of the display/input device surface from the object. The cameras detect reflected infrared ("IR") light received from a coded pattern printed on the object, e.g., playing card or dice. The coded pattern is in various example embodiments a circular printed pattern, a linear printed pattern, a single level matrix printed pattern, a multi-level matrix printed pattern, a variable bit length matrix printed pattern, a black/white (i.e., binary) printed pattern, a gray scale pattern printed, or other suitable pattern disposed on the object. The coded pattern is an identifier of the object or part of the object. For example, the identifier can tell processing 12 and memory 14 operable with the plurality of cameras that the object is a particular playing card, particular dice face, a particular token, or particular wagering or other chip. It should also be appreciated that the coded pattern can be applied to other object such as player gloves and player charms. It should further be appreciated that in the future the display/input device of the game table can be further refined to identify a player's personal identification such as the player's finger prints and that the gaming system can be configured to compare such identification to identifications in a database.

It should be appreciated that the coded patterns are passive in the sense that they do not send or transmit any electrical signals to the display/input device of the game table. Rather, the display/input device is configured to identify (such as by reading or sensing) the coded pattern based on the light reflected from the coded pattern. It should further be appreciated that the coded pattern can be printed on or attached to a device that includes a transmitter and a receiver that are capable of sending electronic signals to and receiving electronic signals from the gaming system or game table. Thus, while such devices are not considered passive with respect to the transmission of such electronic signals, such coded patterns on such device are considered passive. It should also be appreciated that other suitable devices which provide passive image recognition may be employed in accordance with the present disclosure.

In certain embodiments, objects such are cards, dice, chips and wheels are displayed by the game table 100 of gaming system 10. The cameras operate to sense when the displayed cards have been touched by a player or dealer. Processing 12 and memory 14 of game table 100 are modified for this purpose. For example, processing 12 and memory 14 are modified to allow a card or dice to be touched by an actual dealer, who slides the card to the player, and thereafter be handled by the player. Alternatively, processing 12 and memory 14 are configured to provide a virtual dealer who deals a card to the player, and thereafter enable the player to manipulate the displayed card.

Game table 100 displays a primary game, which is a multiple player or player versus player game in one embodiment. Game table 100 may also display any suitable secondary or bonus game associated with the primary game as well as information relating to the primary or secondary game.

As seen in FIG. 1, gaming system 10 for each player includes a credit display 20, which displays a player's current number of credits, cash, account balance, or the equivalent. Gaming system 10 can also display a bet display 22 for each player, which displays a player's amount wagered. In one embodiment, as described in more detail below, gaming system 10 includes a player tracking display 40 for each player, which displays information regarding a player's play tracking status. In one embodiment, game table 100 only shows the above displays 20, 22 and/or 40 at certain times such as between hands of blackjack, so that surface of display/input device 102 of game table 100 can be conserved for base or bonus play.

For the base and bonus games, game table 100 of gaming system 10 is configured to display at least one and a plurality of game or other suitable images, symbols and indicia such as any visual representation or exhibition of the movement of objects such as virtual or video reels and wheels, dice, cards, dynamic lighting, video images, images of people, characters, places, things, faces of cards, and the like.

Any desired player item displayed on game table 100 can be touched, dragged, and resized if it is desirable to do so. Multiple players can touch and move multiple displayed objects simultaneously as discussed above and below. Further, processing 12 and memory 14 are configured such that items can be under control of gaming system 10 at one time and position and be under control of one of the players at another time and position. Other indicia, such as manufacturer label and game name, may be displayed as desired or permanently at one or more positions on game table 100.

As seen in FIG. 1, gaming system 10 in one embodiment includes a secondary such as a large overhead display device 52, which is configured to communicate with game table 100 wirelessly or via a cable 54. Large overhead display device 52 can be seen by each of the players playing gaming system 10 and by nearby patrons. Secondary display device 52 can show any desired information relating to a primary or bonus game being played at game table 100, credit information, player tracking information and/or player attraction indicia.

As illustrated in FIGS. 1 and 2A, in one embodiment, gaming system 10 includes at least one payment device 24, such as a separate payment device 24 for each player, in communication with processing 12. As seen in FIG. 1, a payment device 24 can be a note, ticket or bill acceptor in which the player inserts paper money, a ticket or voucher. Game table 100 can alternatively or additionally include a coin slot 26 in which the player inserts money, coins or tokens. Further alternatively, game table 100 can include a reader or validator for credit cards, debit cards or credit slips for payment acceptance. In one embodiment, a player may insert an identification card into a card reader of gaming system 10, which can be a smart card having a programmed microchip or a magnetic strip encoded with a player's identification, credit totals (or related data), and other relevant information. In another embodiment, a player may carry a portable device, such as a cell phone, a radio frequency identification tag, or any other suitable wireless device, which communicates a player's identification, credit totals (or related data), and other relevant information to gaming system 10. In one embodiment, money may be transferred to a gaming device through an electronic funds transfer. When a player funds gaming system 10, processing 12 determines the amount of funds entered and displays the corresponding amount on the credit or other suitable display as described above.

As seen in FIGS. 1 and 2A, in one embodiment gaming system 10 includes a plurality virtual or electromechanical game table input devices, such as a bet one button 30 in communication with processing 12. The game table input devices enable the player to produce an input signal, which is received by processing 12. Game table 100 provides a bet one button 30 to place a bet. The player can increase the bet by one credit each time the player pushes the bet one button 30. When the player pushes the bet one button 30, the number of credits shown in the credit display decreases by one, and the number of credits shown in the bet display increases by one. In another embodiment, one input device is a bet max button (not shown) which enables the player to bet the maximum wager permitted for a game of gaming system 10 in one button push.

For individual gaming, after appropriate funding of gaming system 10, the player uses a game activation device, such as a play button 32, to start any primary game or sequence of events in gaming system 10. Play button 32 can be any suitable play activator such as a bet one button, a max bet button, or a repeat the bet button. In one embodiment, e.g., for multiple player gaming, upon appropriate funding, gaming system 10 begins the game play automatically. In another embodiment, multiple play buttons 32, e.g., one for each player are provided, wherein game play begins when any player touches his/her play buttons 32.

Game table 100 can also include a cash out button 34, e.g., one for each player. Each player can push the cash out button 34 and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and redeems the value associated with the ticket or credit slip via a cashier (or other suitable redemption system). In another embodiment, when the player cashes out, the player receives the coins or tokens in a coin payout tray (not shown). Alternatively or additionally, gaming system 10 funds credits to each player's electronically recordable identification card.

Game table 100 provides a multi-touch display/input device, which can employ, for example, the technology set forth in the '428 patent. As seen in the diagrammatic example of FIG. 2A, the display/input device 102 is controlled by a controller 44, which is part of processing 12. The display/input device 102 and the controller 44 are connected to a display controller 46, which is also part of processing 12. Multiple players can make decisions and input signals simultaneously into gaming system 10 by touching device (or the surface of device) 102 at the appropriate locations.

In addition to the display/input device, it should also be appreciated that certain of the input devices 103 discussed above can be provided as touch-screen inputs or as an electromechanical inputs located on one or more of the sides 104 of game table 100. It should also be appreciated that if in touch-screen form, the function(s) of any of these input devices can be alternatively provided by the display/input device 102.

Gaming system 10 may further include a plurality of communication ports for enabling communication of processing 12 with external peripherals, such as external video sources, expansion buses, game or other displays, a SCSI port, or a keypad. As illustrated, gaming system 10 optionally includes a remote, e.g., large overhead display device 52, which can display certain features of the base or bonus game, e.g., show how many bonus chips or items each player has accumulated.

In one embodiment, as seen in FIG. 2A, gaming system 10 includes a sound generating device controlled by one or more sounds cards 48, which is part of processing 12, and is operable with a sound generating device, such as a speaker 50. Sound card 48 and speaker 50 can play music for the primary and/or secondary game and for other modes of gaming system 10, such as an attract mode. In one embodiment, gaming system 10 provides dynamic sounds coupled with attractive multimedia images displayed on game table 100 to provide an audio-visual representation or to otherwise display full-motion video with sound to attract players to gaming system 10. During idle periods, gaming system 10 may display a sequence of audio and/or visual attraction messages to attract potential players to gaming system 10. The videos may be customized according to a game theme associated with gaming system 10.

Figure 2B:
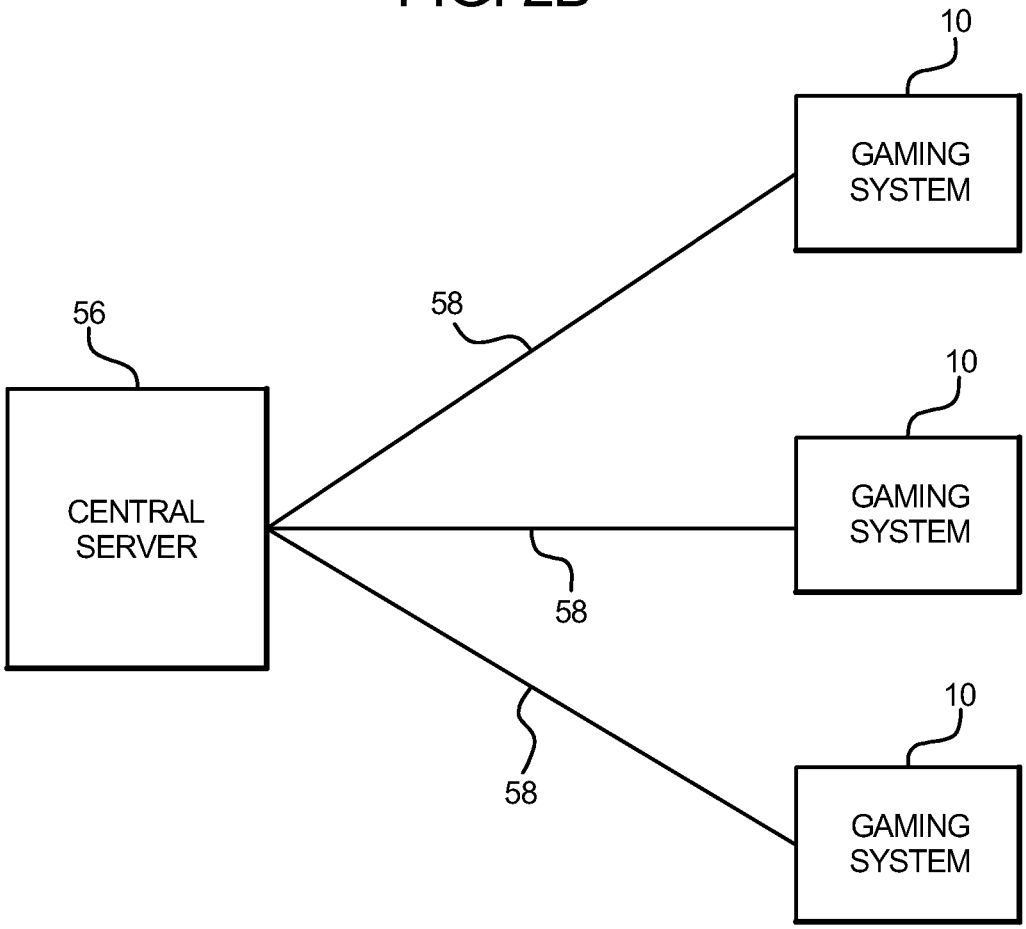
FIG. 2B is a schematic view of one embodiment for a server based configuration networking a plurality of the multiple player simultaneous display/input device game tables of the present disclosure.

In one embodiment, as illustrated in FIG. 2B, one or more of the gaming systems 10 is in communication with each other and/or at least one central server, central controller or remote host 56 through a data network or remote communication link 58. In this embodiment, the central server, central controller or remote host 56 is a server or computing device that includes at least one processor and at least one memory or storage device. In such embodiments, the central server 56 is a progressive controller or a processor of one of gaming systems 10 in the network. In these embodiments, processing 12 of each gaming system 10 is designed to transmit and receive events, messages, commands, or any other suitable data or signal between individual gaming systems 10 and central server 56. Processing 12 of gaming system 10 is configured to execute the above communicated events, messages or commands in conjunction with the operation of gaming system 10. Moreover, processing 12 of central server 56 is configured to transmit and receive events, messages, commands or any other suitable data or signal between central server 56 and each of the individual gaming systems 10. The central server processor is operable to execute such communicated events, messages or commands in conjunction with the operation of central server 56. It should be appreciated that one, more or each of the functions of the central server 56 as disclosed herein may be performed alternatively at processing 12. It should be further appreciated that one, more or each of the functions of processing 12 may be performed by the central server processing.

In one embodiment, the game outcome provided to the player is determined by central server 56 and provided to the player(s) at gaming system 10. Here, each of a plurality of such gaming systems 10 is in communication with central server 56. Upon a player initiating game play at one of gaming systems 10, the initiated gaming system 10 communicates a game outcome request to the central server 56.

In one embodiment, the central server 56 receives the game outcome request and randomly generates a game outcome for the primary game based on probability data. In another embodiment, central server 56 generates a game outcome randomly for the secondary game based on probability data. Here, central server 56 generates a game outcome randomly for both the primary game and the secondary game based on probability data. In this embodiment, the central server 56 is capable of storing and using program code or other data similar to processing 12 and memory 14 of gaming system 10.

In an alternative embodiment, central server 56 maintains one or more predetermined pools or sets of predetermined game outcomes. Here, the central server 56 receives the game outcome request and independently selects a predetermined game outcome from a set or pool of game outcomes. Central server 56 flags or marks the selected game outcome as used. Once a game outcome is flagged as used, it is prevented from further selection from the set or pool and cannot be selected by central server 56 upon another wager. The provided game outcome can include a primary game outcome, a secondary game outcome, primary and secondary game outcomes, or a series of game outcomes such as free games.

Central server 56 communicates the generated or selected game outcome to the initiated gaming system 10. Gaming system 10 receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by central server 56 and communicated to the initiated gaming system 10 to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno or lottery game. Here, each individual gaming system 10 uses one or more bingo, keno, or lottery game to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming system 10 is enrolled in the bingo game, such as upon an appropriate wager or engaging an input device, the enrolled gaming system 10 is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards, while another element may solely be present on one of the bingo cards.

In operation of these embodiments, upon providing or associating a different bingo card with each of a plurality of enrolled gaming systems 10, central server 56 randomly selects or draws, one at a time, a plurality of the elements. As each element is selected, a determination is made for each gaming system 10 as to whether the selected element is present on the bingo card provided to that enrolled gaming system 10. This determination can be made at central server 56, gaming system 10, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined pattern is marked on one or more of the provided bingo cards. It should be appreciated that in one embodiment, gaming system 10 requires the player to engage a daub button (not shown) to initiate the process of gaming system 10 marking or flagging any selected elements.

After one or more predetermined pattern is marked on one or more of the provided bingo cards, a game outcome is determined for each of the enrolled gaming system 10 based, at least in part, on the selected elements on the provided bingo cards. As described above, the game outcome determined for each gaming system 10 enrolled in the bingo game is used by that gaming system 10 to determine the predetermined game outcome provided to the player. For example, a first gaming system 10 to have selected elements marked in a predetermined pattern is provided a first outcome of win $10, which is provided to a first player regardless of how the first player plays in a first game, and a second gaming system 10 to have selected elements marked in a different predetermined pattern is provided a second outcome of win $2, which is provided to a second player regardless of how the second player plays a second game. It should be appreciated that as the process of marking selected elements continues until one or more predetermined pattern is marked, this embodiment ensures that at least one bingo card wins the bingo game and thus at least one enrolled gaming system 10 provides a predetermined winning game outcome to a player. It should be appreciated that other suitable methods for selecting or determining one or more predetermined game outcome may be employed.

In one example of the above-described embodiment, the predetermined game outcome may be based on a supplemental award in addition to any award provided for winning the bingo game as described above. Here, if one or more element is marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming system 10 may be provided a supplemental or intermittent award regardless of whether the enrolled gaming system's provided bingo card wins or does not win the bingo game as described above.

In another embodiment, one or more of gaming systems 10 is in communication with central server 56 for monitoring purposes only. That is, each individual gaming system 10 randomly generates the game outcomes to be provided to the player, and the central server 56 monitors the activities and events occurring on the plurality of gaming systems 10. In one embodiment, the gaming network includes a real-time or on-line accounting and gaming information system coupled operably to central server 56. The accounting and gaming information system of this embodiment includes a player database for storing player profiles, a player tracking module for tracking players and a credit system for providing automated casino transactions.

In one embodiment, gaming system 10 is associated with or otherwise integrated with one or more player tracking system. Player tracking systems enable gaming establishments to recognize the value of customer loyalty through identifying frequent customers and rewarding them for their patronage. In one embodiment, gaming system 10 and/or the player tracking system tracks any player's gaming activity at gaming system 10. In one such embodiment, gaming system 10 includes at least one card reader 38, located, e.g., at a side 104 of game table 100, which is in communication with processing 12. Here, a player is issued a player identification card that has an encoded player identification number that uniquely identifies the player. When a player inserts their playing tracking card into card reader 38 to begin a gaming session, card reader 38 reads the player identification number off the player tracking card to identify the player. Gaming system 10 and/or the associated player tracking system timely tracks information or data relating to the identified player's gaming session.

Directly or via the central server 56, processing 12 of gaming system 10 communicates such information to the player tracking system. Gaming system 10 and/or associated player tracking system also timely tracks when a player removes their player tracking card when concluding play for that gaming session. In another embodiment, rather than requiring a player to insert a player tracking card, gaming system 10 uses one or more portable device carried by a player, such as a cell phone, a radio frequency identification tag or any other suitable wireless device to track when a player begins and ends a gaming session. In another embodiment, gaming system 10 utilizes any suitable biometric technology or ticket technology to track when a player begins and ends a gaming session.

It should also be appreciated that the current player tracking cards can be modified to be read by the IR cameras. For example, the player tracking cards can include an IR tag instead of or in addition to the magnetic strip currently on the card readers.

During one or more gaming session, the player tracking system tracks player information or data, such as any amounts wagered, average wager amounts, and/or the time at which these wagers are placed. In different embodiments, for one or more player, the player tracking system includes the player's account number, the player's card number, the player's first name, the player's surname, the player's preferred name, the player's player tracking ranking, any promotional status associated with the player's player tracking card, the player's address, the player's birthday, the player's anniversary, the player's recent gaming sessions or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service window (not shown), which is displayed on surface of display/input device 102 of game table 100.

In one embodiment, a plurality of gaming systems 10 are capable of being connected together through a data network. In one embodiment, the data network is a local area network ("LAN"), in a plurality of gaming systems 10 are located proximate to each other and an on-site central server or controller as in, for example, a gaming establishment or a portion of a gaming establishment. In another embodiment, the data network is a wide area network ("WAN"), in which a plurality of the gaming systems 10 are in communication with at least one off-site central server. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. Here, operation of gaming system 10 and accumulation of credits may be accomplished with only a connection to the central server 56 (the internet/intranet server) through a conventional phone or other data transmission line, digital subscriber line (DSL), T-1 line, coaxial cable, fiber optic cable, or other suitable connection. Players may access an internet game page from any location in which an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices is in communication with a central server 56. In one embodiment, the memory of central server 56 stores different game programs and instructions, executable by gaming system processing 12, to control gaming system 10. Each executable game program represents a different game or type of game, which may be played on one or more gaming system 10 in the network. Such different games may include the same or substantially the same game play with different pay tables. In different embodiments, the executable game program is for a primary game, a secondary game or both. In another embodiment, the game program may be executed as a secondary game to be played simultaneous with the play of a primary game (which may be downloaded to or fixed on gaming system 10) or vice versa.

In operation, central server 56 communicates one or more of the stored game programs to local processing 12 of at least one gaming system 10. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet or telephone line. After the stored game programs are communicated from the central server 56, local processing 12 executes the communicated program to facilitate play of the communicated program by a player through game table 100 of gaming system 10. That is, when a game program is communicated to local processing 12, the local processing changes the game or type of game played at gaming system 10.

In another embodiment, a plurality of gaming systems 10 at one or more gaming site are networked to central server 56 in a progressive configuration, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming systems 10 distributed throughout a number of properties at different geographical locations including, for example, different locations within a city or different cities within a state.

In one embodiment, the progressive gaming system host site computer is maintained for the overall operation and control of the progressive gaming system. Here, a progressive gaming system host site computer oversees the entire progressive gaming system and is the master for computing all progressive jackpots. All participating gaming sites report to, and receive information from, the progressive gaming system host site computer. Each central server 56 is responsible for all data communication between gaming system 10 hardware and software and the progressive gaming system host site computer. In one embodiment, an individual gaming system 10 may trigger a progressive award win. In another embodiment, a central server 56 (or the progressive gaming system host site computer) determines when a progressive award win is triggered. In a further embodiment, an individual gaming system 10 and a central server 56 (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, gaming system 10 is randomly or apparently randomly selected to provide a player of that gaming system one or more progressive award. In one such embodiment, gaming system 10 does not provide any apparent reason to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards is each funded via a side bet or side wager. Here, a player places or wagers a side bet to be eligible to win the progressive award associated with the side bet. In one embodiment, the player has to place the maximum bet and the side bet to be eligible to win one of the progressive awards. In another embodiment, if the player places or wagers the required side bet, the player may wager any credit amount during the primary game (the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of gaming system 10, via a gaming establishment or via any suitable manner.

In another embodiment, one or more of the progressive awards is partially funded via a side-bet or side-wager which the player may make (and which may be tracked via a side-bet meter). In a further embodiment, one or more of the progressive awards is funded with only side-bets or side-wagers placed. In still another embodiment, one or more of the progressive awards is funded based on players' wagers as described above as well as any side-bets or side-wagers placed.

In still a further alternative embodiment, a minimum wager level is required for a gaming system 10 to qualify to be selected to obtain one of the progressive awards. In one embodiment, this minimum wager level is the maximum wager level for the primary game in gaming system 10. In another embodiment, no minimum wager level is required for a gaming machine to qualify to be selected to obtain one of the progressive awards.

As described in more detail below, a plurality of players at a plurality of linked gaming systems 10 participate in a group gaming environment. In one embodiment, a plurality of players at a plurality of linked gaming systems work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming systems 10 compete against one another for one or more awards. In one such embodiment, a plurality of players at a plurality of linked gaming systems 10 participate in a gaming tournament for one or more awards. In another embodiment, a plurality of players at a plurality of linked gaming systems 10 play for one or more award, wherein an outcome generated by one gaming system 10 affects the outcomes generated by one or more other linked gaming system.

Gaming system 10 can incorporate any suitable wagering game as the primary or base game. The primary or base game may comprise a single player game, such as a reel-type game, card game, cascading or falling symbol game, number game, or other game of chance that can be configured in an electronic which in one embodiment produces a random outcome based on probability data at the time of or after placement of a wager. Gaming system 10 can be configured to play video poker, video blackjack, video keno, video bingo or baccarat, for example, in single player format or in table game format, e.g., multiple blackjack players against a dealer or multiple poker players playing against one another.

In one embodiment, gaming system 10 displays a slot game that may be a base or bonus game for the gaming system. In the slot game of gaming system 10, game table 100 displays multiple paylines, which may be horizontal, vertical, circular, diagonal, angled or any combination thereof. The paylines operate with at least one reel, such as three to five reels. Each reel includes a plurality of indicia or symbols, such as bells, hearts, fruits, numbers, letters, bars, or other images which correspond to a theme associated with gaming system 10. In another embodiment, one or more of the reels are independent reels or unisymbol reels. In this embodiment, each independent or unisymbol reel generates and displays one symbol to the player. The slot version of gaming system 10 awards prizes after the reels stop spinning if specified types and/or configurations of indicia or symbols occur on an active payline.

In an alternative embodiment, rather than determining any outcome to provide to the player by analyzing the symbols generated on any wagered upon paylines as described above, gaming system 10 determines any outcome to provide to the player based on the number of associated symbols which are generated in active symbol positions on the requisite number of adjacent reels (i.e., not on paylines passing through any displayed winning symbol combinations). Here, if a winning symbol combination is generated on the reels, gaming system 10 provides the player one award for that occurrence of the generated winning symbol combination. For example, if one winning symbol combination is generated on the reels, gaming system 10 provides a single award to the player for that winning symbol combination (e.g., not based on the number of paylines that would have passed through that winning symbol combination). Here, the slot game may provide the player more than one award for the same occurrence of a single winning symbol combination (e.g., if a plurality of paylines each pass through the same winning symbol combination).

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of gaming system 10 with at least one symbol generated in an active symbol position. For example, a three reel gaming system 10 with three symbols generated in active symbol positions on each reel includes twenty-seven ways to win (e.g., three symbols on the first reel×three symbols on the second reel×three symbols on the third reel). A four reel gaming system 10 with three symbols generated in active symbol positions on each reel includes eighty-one ways to win (e.g., three symbols on the first reel×three symbols on the second reel×three symbols on the third reel×three symbols on the fourth reel). A five reel gaming system 10 with three symbols generated in active symbol positions on each reel includes 243 ways to win (e.g., three symbols on the first reel×three symbols on the second reel×three symbols on the third reel×three symbols on the fourth reel×three symbols on the fifth reel). It should be appreciated that modifying the number of generated symbols by either modifying the number of reels or modifying the number of symbols generated in active symbol positions by one or more of the reels modifies the number of ways to win.

In another embodiment, the slot version of gaming system 10 enables a player to wager on and thus activate symbol positions. In one such embodiment, the symbol positions are on the reels. Here, if based on the player's wager, a reel is activated, then each of the symbol positions of that reel is activated and each of the active symbol positions is part of one or more of the ways to win. In another embodiment, if based on the player's wager, a reel is not activated, then a designated number of default symbol positions, such as a single symbol position of the middle row of the reel, is activated and the default symbol position(s) is/are part of one or more of the ways to win. This type of gaming machine enables a player to wager on one, more than one, or all of the reels of gaming system 10. Processing 12 uses the number of wagered-on reels to determine the active symbol positions and the number of possible ways to win.

In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment in which a player wagers on one or more reel, a player's wager of one credit may activate each of the three symbol positions on a first reel, wherein one default symbol position is activated on each of the remaining four reels. In this example, as described above, the slot version of gaming system 10 provides the player three ways to win (e.g., three symbols on the first reel×one symbol on the second reel×one symbol on the third reel×one symbol on the fourth reel×one symbol on the fifth reel). In another example, a player's wager of nine credits activates each of the three symbol positions on a first reel, each of the three symbol positions on a second reel and each of the three symbol positions on a third reel, wherein one default symbol position is activated on each of the remaining two reels. In this example, as described above, gaming system 10 provides the player twenty-seven ways to win (e.g., three symbols on the first reel×three symbols on the second reel×three symbols on the third reel×one symbol on the fourth reel×one symbol on the fifth reel).

In one embodiment, to determine any award(s) to provide to the player based on the generated symbols, gaming system 10 individually determines if a symbol generated in an active symbol position on a first reel forms part of a winning symbol combination with or is otherwise suitably related to a symbol generated in an active symbol position on a second reel. Here, gaming system 10 classifies each pair of symbols that form part of a winning symbol combination (e.g., each pair of related symbols) as a string of related symbols. For example, if active symbol positions include a first cherry symbol generated in the top row of a first reel and a second cherry symbol generated in the bottom row of a second reel, gaming system 10 classifies the two cherry symbols as a string of related symbols because the two cherry symbols form part of a winning symbol combination.

After determining if any strings of related symbols are formed between the symbols on the first reel and the symbols on the second reel, gaming system 10 determines if any of the symbols from the next adjacent reel should be added to any of the formed strings of related symbols. Here, for a first of the classified strings of related symbols, gaming system 10 determines if any of the symbols generated by the next adjacent reel form part of a winning symbol combination or are otherwise related to the symbols of the first string of related symbols. If gaming system 10 determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the slot version of gaming system 10 adds the related cherry symbol generated on the third reel to the previously classified string of cherry symbols.

On the other hand, if gaming system 10 determines that no symbols generated on the next adjacent reel are related to the symbols of the first string of related symbols, the slot version of gaming system 10 marks or flags such string of related symbols as complete. For example, if the first string of related symbols is the string of related cherry symbols and none of the symbols of the third reel are related to the cherry symbols of the previously classified string of cherry symbols, gaming system 10 marks or flags the string of two cherry symbols as complete.

After either adding a related symbol to the first string of related symbols or marking the first string of related symbols as complete, the slot version of gaming system 10 proceeds as described above for each of the remaining classified strings of related symbols which were previously classified or formed from related symbols on the first and second reels.

After analyzing each of the remaining strings of related symbols, the slot version of gaming system 10 determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, gaming system 10 marks each of the remaining pending strings of related symbols as complete.

When each of the strings of related symbols is marked complete, the slot version of gaming system 10 compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

Poker Game Example Embodiments

In one embodiment, game table 100 of gaming system 10 displays a poker game, in which the player plays a conventional game of video draw poker and initially deals five cards all face up from a virtual deck of fifty-two cards. Cards may be dealt as in a traditional game of cards, e.g., from the top of the deck or the cards may be randomly selected from a predetermined number of cards. If the player wishes to draw a card, the player selects the cards to hold via the display/input device. The player presses a deal button, which can be virtual and the unwanted or discarded cards are removed from surface of display/input device 102 of game table 100. The poker version of gaming system 10 deals the replacement cards from the remaining cards in the deck. This results in a final five-card hand. Gaming system 10 compares the final five-card hand to a payout table which utilizes conventional poker hand rankings to determine the winning hands. Gaming system 10 provides the player with an award based on a winning hand and the number of credits the player wagered.

In another embodiment, the poker version of gaming device 100 plays a multi-hand version of video poker. Here, gaming system 10 deals the player at least two hands of cards. In one embodiment each hand of cards is associated with its own deck of cards. The player chooses the cards to hold in a primary hand. The held cards in the primary hand are also held in the other hands of cards. The remaining non-held cards are removed from each hand displayed and replacement cards are dealt randomly into each hand. Since the replacement cards are dealt randomly and independently for each hand, the replacement cards for each hand can and usually will be different. The poker hand rankings are then determined hand by hand against a payout table and awards are provided to the player.

As discussed herein, game table 100 is particularly well-suited for multiple player, interactive gaming in which multiple players play at the same time against a dealer or against each other. It is accordingly expressly contemplated to provide a video poker game on interactive game table 100 in which players play against each other. A deck of cards moves from player to player, each player taking turns as dealer. Alternatively, a separate (actual or virtual dealer) deals the cards to the group of players. The dealing of virtual cards is discussed in detail below.

The poker game can be any suitable poker game. For example, the poker game can be a five card stud game in which four cards are dealt face-up. The players then raise or fold. The fifth card is then dealt face-up and the winning player is awarded the pot.

Figure 3:
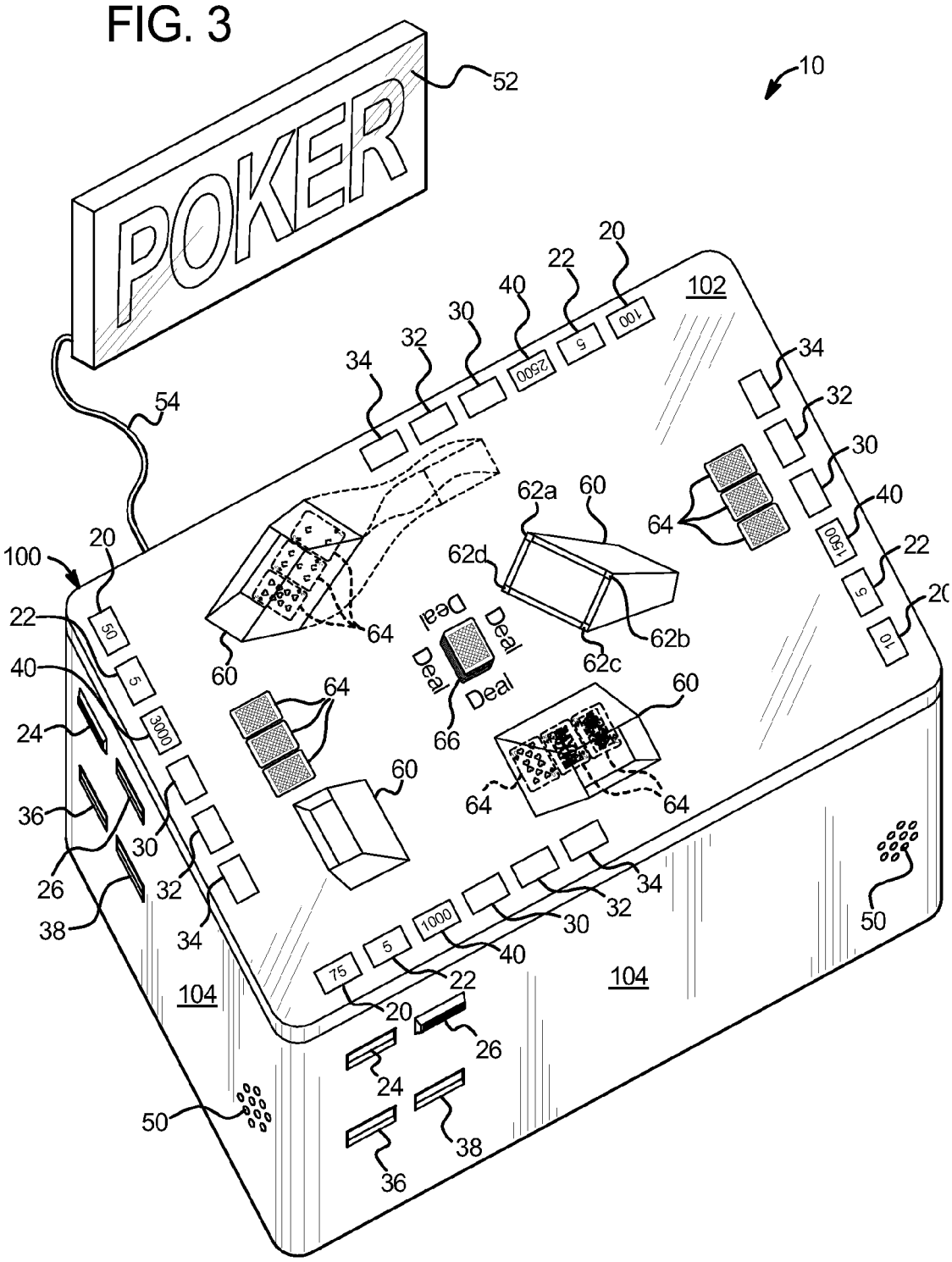
FIG. 3 is a perspective view of one embodiment of a gaming system having the multiple player simultaneous display/input game table of the present disclosure operating a poker game.

Referring now to FIG. 3, in an alternative embodiment, cards can be dealt in a poker game face-down. The embodiment shows a transition from game table control to player of the movement of cards. The player can move the cards by touching the cards or be using an external physical viewing device to move the cards. Further, multiple players can move their cards at the same time via either method above. Processing 12 of game table 100 facilitates this multitasking. The viewer 60 also illustrates use of an external physical device operable with game table 100, which modifies the game of game table 100 and also works in conjunction with features displayed by the game table.

In the poker game of FIG. 3, gaming system 10 via game table 100 deals displayed cards 64 face down to each player, which game table 100 can provide or snap to a designated position of surface of display/input device 102 in front of each player. Each player has a viewer 60, having four separate encodings 62*a* to 62*d*, such as the RF encodings discussed above and in relation to the '428 patent. The encoding or tags 62*a* to 62*d* herein can be for example radio frequency tags, barcode tags, and dot coded tags.

The encodings are located at the bottom corners of viewer 60 as generally seen in FIG. 3. Gaming system 10 or game table 100 knows where cards 64 are located. Each player can move their cards 64, which in one embodiment travel together, e.g., two or three at a time, such that the cards 64 cannot be moved towards or away from each other. Game table 100 deals a second face-down card 64, which is provided or snaps into position next to the first face down card 64, deals the third face-down card 64 so that it is provided or snaps into position next to the first and second face-down cards 64, and so on.

Game table 100 is configured to sense when the four encodings 62*a* to 62*d* of viewer 60 are centered around or adjacent to face-down cards 64, such that viewer 60 blocks the view of cards 64 to all except the player having such cards. To this end in the illustrated embodiment, viewer 60 is tilted and narrowed as necessary to enable the player see cards 64 readily while blocking the cards 64 from the other players and nearby patrons.

Once viewer 60 is centered over the face-down cards, game table 100 reveals the cards 64 within the viewer to the player holding the cards 64. If the player moves viewer 60 while centered over the face-down cards 64, the cards move with the viewer 60. As soon as any of the encodings 62*a* to 62*d* is not sensed to be at its appropriate position, game table 100 masks or hides cards 64 (simulating turning the cards back over). Using viewer 60 and game table 100 configured as discussed above, gaming system 10 can provide any suitable type of face-down poker game, including a table poker game in which players play against each other.

The poker game of FIG. 3 highlights various capabilities or functionality of gaming system 10 and game table 100. Game table 100 controls the movement of cards 64 from the deck 66 of cards 64 to the different dealt positions in front of the players. Afterwards, control of the movement of cards 64 is relinquished to the player. Cards 64 can be moved by touching the cards or by placing viewer 60 over the cards and moving the viewer. The game table 100 enables players to move their cards 64 simultaneously via either of such methods. Multiple IR cameras within game table 100 enable multiple inputs to be made to the game table at the same time. Processing 12 within game table 100 is configured to perform multiple tasks simultaneously, e.g., enable multiple viewers/card hands to be moved simultaneously.

Keno Game Example Embodiments

In one embodiment, game table 100 of gaming system 10 displays a keno game which includes a plurality of selectable indicia or numbers on game table 100. Here, the player selects at least one of the selectable indicia or numbers via an input device such as a touch screen. Gaming system 10 then displays a series of drawn numbers and determines an amount of matches, if any, between the player's selected numbers and gaming system 10's drawn numbers. The player is provided an award based on the amount of matches, if any, between the player's picked numbers and the game's drawn numbers and the total number of numbers picked by the player.

As discussed herein, game table 100 is particularly well-suited for multiple player interactive gaming in which multiple players play at the same time against a dealer or against each other. In one embodiment, multiple players play against the same house draw. In single player keno, game table 100 can be configured to let the player touch a number to select it after which the number is highlighted somehow. With multiple players, the same number can be marked in two ways if two players select the number and so on.

Figure 4:
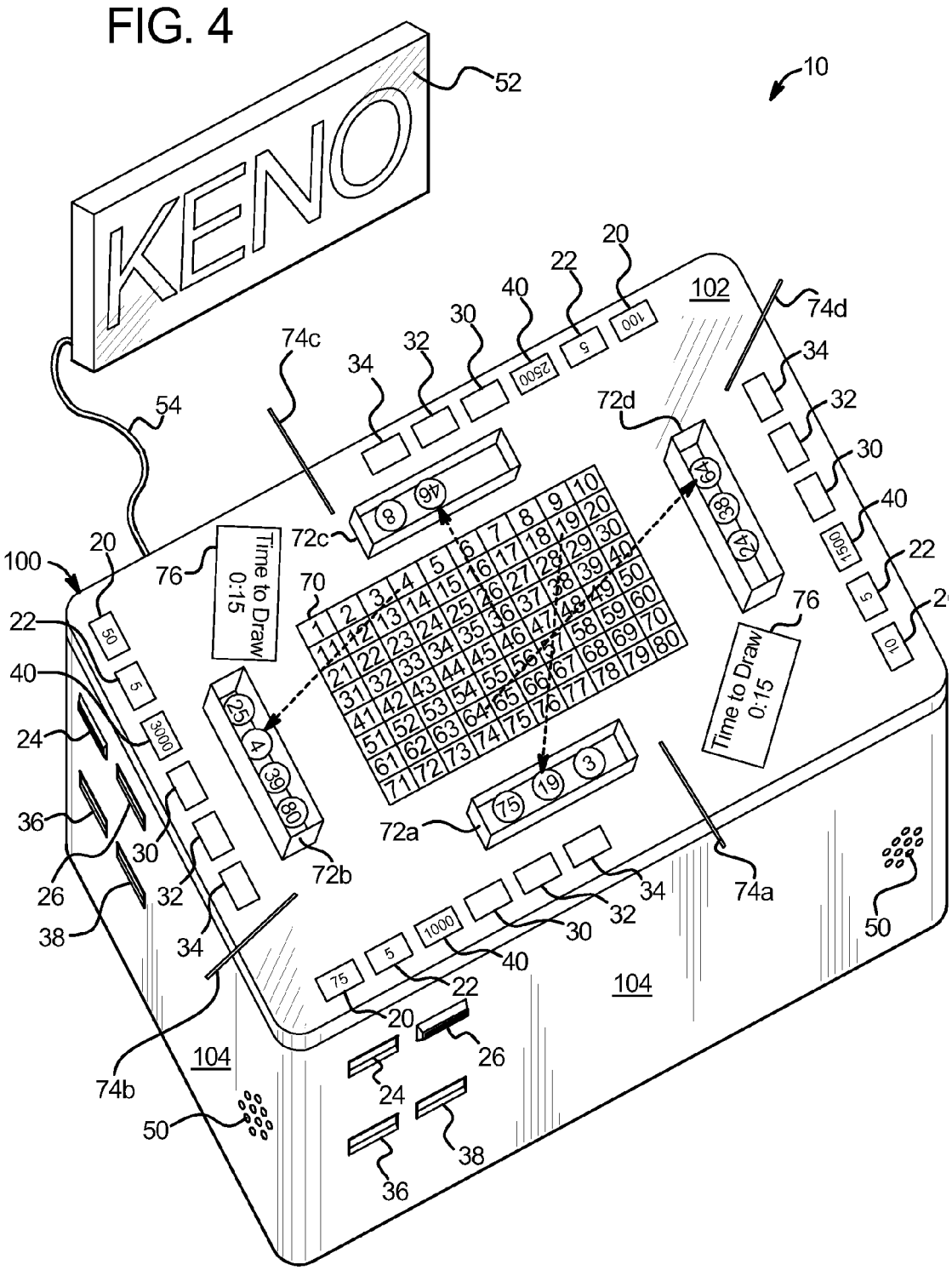
FIG. 4 is a perspective view of one embodiment of a gaming system having the multiple player simultaneous display/input game table of the present disclosure operating a keno game.

Referring now to FIG. 4, an alternative keno game highlights various capabilities or functionality of gaming system 10. The game enables players to make keno picks simultaneously using the same surface of display/input device 102 of game table 100. In this illustrated embodiment, game table 100 enables each player to move the player's own number collection station or "basket" to a desirable area on surface of display/input device 102 near the player. Also common displays, such as time remaining until draw display 76, can be moved to any suitable position on surface of display/input device 102 desired by the players collectively. Game table 100 therefore enables game-by-game customization of the display and input of information.

In the keno game of FIG. 4, each player can grab a copy of any desired number from a virtual number array 70 and slide the number copies into the player's virtual basket 72*a* to 72*d*, leaving the original of the number at the number array 70. If the player lifts the player's hand from surface of display/input device 102 before the number copy reaches the basket, the number copy either disappears or snaps back to the original of the number at array 70. Alternatively, the number copy can sit at the position at which it has been left for a period of time or up until gaming system 10 begins to draw numbers. As that time arrives, the number copy can flash for a few seconds to prompt the player. A player can slide a number copy out of his/her basket 72*a* to 72*d*, at which time it either disappears or snaps back to the original. If a player slides the same number copy into his/her basket 72*a* to 72*d*, gaming system 10 can either ignore the later selected copy or consider it an increase in the player's wager.

Game table 100 is configured such that a player can drag a copy of a particular number over the original of another number located in number array 70 without selecting that other number. If the player's finger does not provide enough resolution given the spacing of numbers within array 70, gaming system 10 can be provided with suitable wands 74*a* to 74*d*, respectively, for each player. Each wand may have a tag or may have an encoded tip. The tag or encoded tip can be provided if for example the casino or manufacturer does not want players using non-authorized wands.

Gaming system 10 highlights its drawn numbers at array 70. Any number in the player's basket 72*a* to 72*d* that matches a number drawn by gaming system 10 is highlighted to show the player that the match has occurred. The matched numbers at the end of the draw are counted and each player is paid according to a paytable.

The keno game of FIG. 4 highlights various capabilities or functionality of gaming system 10. Here, the game can, but does not have to, be sequential. The keno game in one embodiment enables the players to independently choose when to pick desired keno numbers up until the time of the draw, shown in time displays 76. There is no set sequence, which enhances player interaction as the players crisscross each other to pick their numbers. Virtual baskets 72*a* to 72*d* can be moved to any position on surface of display/input device 102 desired by the players. Game table 100 also enables displays 76 to be moved to positions that are acceptable to the players collectively.

Bonus Game Embodiments

In various embodiment, in addition to winning credits or other awards in a base or primary game, gaming system 10 also provides players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game. The triggering of one bonus game for gaming system 10 via game play is discussed in detail below. In other embodiments, the triggering event or qualifying condition occurs based on exceeding a certain amount of game play (such as number of games, number of credits, amount of time), or reaching a specified number of points earned during game play.

In another embodiment, processing 12 of gaming system 10 or a central server 56 (see FIG. 2B discussed above) provides the player one or more plays of one or more secondary games randomly. In one such embodiment, gaming system 10 does not provide any apparent reason to the player for qualifying to play a secondary or bonus game. Here, qualifying for a bonus game is not triggered by an event in or based specifically on any of the plays of any primary game. That is, gaming system 10 may simply qualify a player to play a secondary game without any explanation or alternatively with simple explanations. In another embodiment, gaming system 10 (or central server 56) qualifies a player for a secondary game at least partially based on a game triggered or symbol triggered event, such as at least partially based on the play of a primary game.

In one embodiment, gaming system 10 includes a program which begins automatically a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player. One example of a "buy-in" discussed below is a side bet. The player must make a separate side-wager on the bonus game or wager a designated amount in the primary game to qualify for the secondary game.

Blackjack Game with Promotional Bonus Example Embodiments

Figure 5:
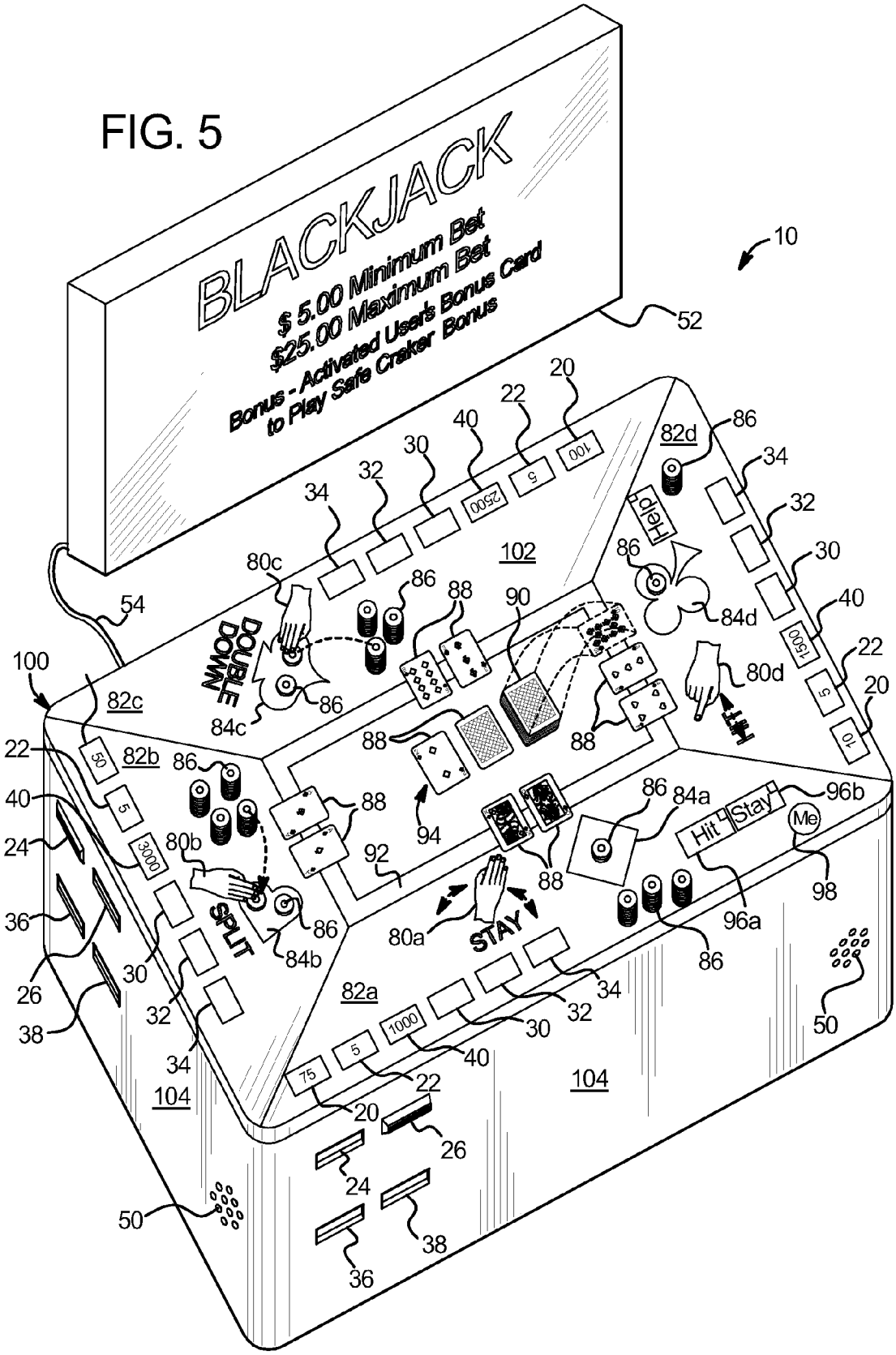
FIG. 5 is a perspective view of one embodiment of a gaming system having the multiple player simultaneous display/input device game table of the present disclosure operating a blackjack base game having a bonus game.

Referring now to FIG. 5, one example of how the game table of the present disclosures can be employed is show by the embodiment of a blackjack game using game table 100. The blackjack game illustrates simultaneous game play on a single display/input device of the game table 100. The blackjack game illustrates providing certain areas for each player and enabling each player to customize their area as well as being the only player allowed to input changes in the area. The blackjack game illustrates a transition from game control of the movement of game items to game control of such items. The blackjack game illustrates space optimization of surface of display/input device 102 of game table 100, including moveable displayed chips, game pieces and input devices that can be minimized. The displayed chips can be "handled" or moved singly or in bulk. The displayed game via game table 100 is played using many of the same methods as actual table blackjack such as placing additional chips to double down or split.

In the blackjack embodiment of FIG. 5, four players 80*a*, 80*b*, 80*c*, and 80*d* play the blackjack game simultaneously, each player having a corresponding quadrant 82*a*, 82*a*, 82*b*, and 82*d*, respectively, of surface of display/input device 102. Player 80*a* is the diamond player and places his or her bet on moveable diamond wager placement area 84*a*. Player 80*b* is the heart player and places his or her bet on moveable heart wager placement area 84*b*. Player 80*c* is the spade player and places his or her bet on moveable spade wager placement area 84*c*. Player 80*d* is the clubs player and places his or her bet on moveable clubs wager placement area 84*d*. Each wager placement area 84*a* to 84*d* is moveable only within each player's quadrant 82*a* to 82*d* in one embodiment. Wager placement areas 84*a* to 84*d* are displayed in the illustrated embodiment.

Each player has a plurality of displayed chips 86, which are placed in stacks. For example, for a $5.00 minimum table, a player cashing in $20.00 will get a stack of four chips 86. A player cashing in $100.00 can get, for example, two stacks of 10 chips. The displayed chips appear in three-dimensions with bottom chips appearing to be under surface of display/input device 102. The three-dimensional images are customized for each player's position as illustrated, so that the images are oriented properly for the different positions at game table 100.

Game table 100 deals displayed cards 88 from displayed deck 90 onto deal rail 92. Typically, players are not supposed to touch their cards in blackjack, so cards 88 are not moveable once dealt in one embodiment. FIG. 5 illustrates a card 88 being dealt from deck 90 to player 80*d*. Game table 100 slides the card off of the deck into the proper position on rail 92. As the sliding takes place or once the card reaches rail 92, game table 100 reveals the card to the player.

Game table 100 also deals the dealer's displayed hand 94. A first card is dealt face-down, and second card is dealt face-up adjacent to the face-down card to form the dealer hand 94 as shown. The blackjack game proceeds sequentially such as beginning with diamond player 80*a*. Upon being dealt a king and a queen, player 80*a* decides to stay. To do so, player 80*a* moves his or her hand side-to-side above surface of display/input device 102 as illustrated, within quadrant 82*a*, which at this time is the only active quadrant. One or more IR capable cameras or readers beneath surface of display/input device 102 detects the player's hand moving side to side without the player having to actually touch surface of display/input device 102. Actions taken in other quadrants 82 (referring collectively to remaining quadrants) are ignored or not allowed in one embodiment, although in other embodiments, players can simultaneously make inputs.

Game table 100 then activates quadrant 82*b* for heart player 80*b*. In one embodiment, Active quadrants are highlighted such as brightened as non-active quadrants are dulled. Upon being dealt a pair of aces, player 80*b* decides to split the pair. To do so player 80*b* moves a displayed chip 86 from one of his or her piles to wager placement area 84*b* as illustrated, located within quadrant 82*b*, which at this time is the only active quadrant. In this embodiment, actions taken in other quadrants 82 (referring collectively to remaining quadrants) are ignored or not allowed.

In one embodiment, placing the player's finger directly over but not touching surface of display/input device 102 highlights the top chip and causes the top chip 86 to follow the player's finger to wager placement area 84*b*, where it is snapped into position. Touching the pile of chips 86 highlights the entire stack, which can then be moved as a stack to different parts of the player's quadrant or to the wager placement area. In one embodiment, the player can move his or her chips within the respective quadrant while it is non-active but cannot wager the chips. Even when a quadrant is active, an invalid additional wager attempt is ignored such as the displayed chips are not allowed to enter the wager placement area.

In another embodiment, touching a stack of chips once causes the top chip to be highlighted and be moveable. The number "1" can appear on the top chip. Touching a stack of chips twice in succession causes the two top chips 86 to be highlighted and be moveable. The number "2" can appear on the top chip, and so on. Once the number of taps exceeds the number of chips 86 in a stack, no chips are highlighted so that the player can undue a wager decision.

Game table 100 then activates quadrant 82*c* for spade player 80*c*. Upon being dealt a three and an eight, player 80*c* decides to double down. To do so, player 80*c* moves a displayed chip 86 from one of his or her piles to wager placement area 84*c* as illustrated, located within quadrant 82*c*, which at this time is the only active quadrant. Actions taken in other quadrants 82 (referring collectively to remaining quadrants) are ignored or not allowed.

The quadrants as illustrated provide a visual confirm message, e.g., "stay", "split", "double down" and "hit" to confirm the player's choice and to provide a hand-shake like message to the player that game table 100 understands the player's intent. In one embodiment, the player can remove a chip 86 from a wager placement area after placing the chip in the area until the player moves his or her hand off of the chip and away from the wager placement area, after which the bet is made and credit meter 20 and bet meter 22 are updated accordingly. The above mentioned "split" or "double down" confirm messages are shown as soon as the chip beings to enter the wager placement area, so that the player is made aware that game table 100 is about to be accept the wager.

Game table 100 then activates quadrant 82*d* for clubs player 80*d*. Upon being dealt a four and a three, player 80*d* decides to hit. To do so, player 80*d* moves his or her hand up and down above surface of display/input device 102 as illustrated, within quadrant 82*d*, which at this time is the only active quadrant. One or more IR capable cameras or reader beneath surface of display/input device 102 detects the player's hand moving up and down without the player having to actually touch surface of display/input device 102. Actions taken in other quadrants 82 (referring collectively to remaining quadrants) are ignored or not allowed. Confirm message "hit" enables game table 100 to hand shake with the player letting the player know that an additional card, here a ten, is going to be dealt.

Quadrant 82*a* shows an alternative apparatus and method for the player to "hit" or "stay". Game table 100 provides a "hit" button 96*a*, which the player can press for an additional card. Game table provides a "stay" button 96*b*, which the player can press to not accept another card. "Hit" button 96*a* and "stay" button 96*b* each include a minimize symbol "–," which the player can press to cause the associated button to become minimized. It is contemplated to provide a number of options that are normally minimized to conserve surface of display/input device 102 as a bank of expand symbols "+" 96*c* (here along the playing side of deal bar 92). The player can press any of the expand symbols 96*c* to enlarge the symbol to a button and activate the function of the button. When the player no longer wishes to have the button enabled, the player pressed minimize symbol "–," after which the corresponding expand symbol "+" 96*c* appears at its designated position along the bank of symbols 96. Symbols 96 can be color coded. Maintaining consistent positioning of the symbols in the back also enables players to become familiar with the symbols quickly.

In various embodiments, the game table provides extra functionality to each player through one or more inputs. For example, a "Me" button 98 (which can also be minimized) enables the players to respectively customize the player stations 82*a* to 82*d*. For example, pressing "Me" button 98 can enable the player to change game symbols, e.g., from the heart to a favorite sports or school logo, change background color, set background, e.g., from a menu of backgrounds, change loudness of sound from speakers 50, or changes brightness. "Me" button 98 can also provide help to a player when deciding to hit or stay (which may be always available or only when player has lost a certain amount or has only a certain amount of credits or chips remaining, since gaming system 10 or game table 100 knows how many credits the player has). In various embodiments, such extra inputs enable multiple players to each perform extra activities while playing the primary or secondary games on the same display/input device. These extra activities can range from playing side games to using the internet. It should be appreciated that the "me" button can also enable the player to access an player account such as a player tracking account. Each player's account can store any suitable information regarding or for the player such as, but not limited to, player preferences, favorite games, and favorite table layout, configurations or colors. It should also be appreciated that in certain embodiments, the "me" button enables the player to access non-gaming concierge functions, such as placing food and/or beverage order, securing a reservation at a restaurant, or purchasing show tickets.

It should thus be appreciated that the blackjack game of FIG. 5 can be simultaneously played by multiple players wagering on game table 100 of gaming system 10 in any of the ways described herein. In various embodiments, the tags or encodings of gaming system 10 can be stored in association with a personalized player card. The card for example, can be used to identify the player and for other purposes such as for providing a source of funds and payout method for playing such games and other games.

Such cards, as described further below, can also be used in a promotional game such as to enable players to become familiar with gaming system 10. Such cards can also be used to locate a base or bonus game on game table 100 and/or to interact with the game.

Figure 6:
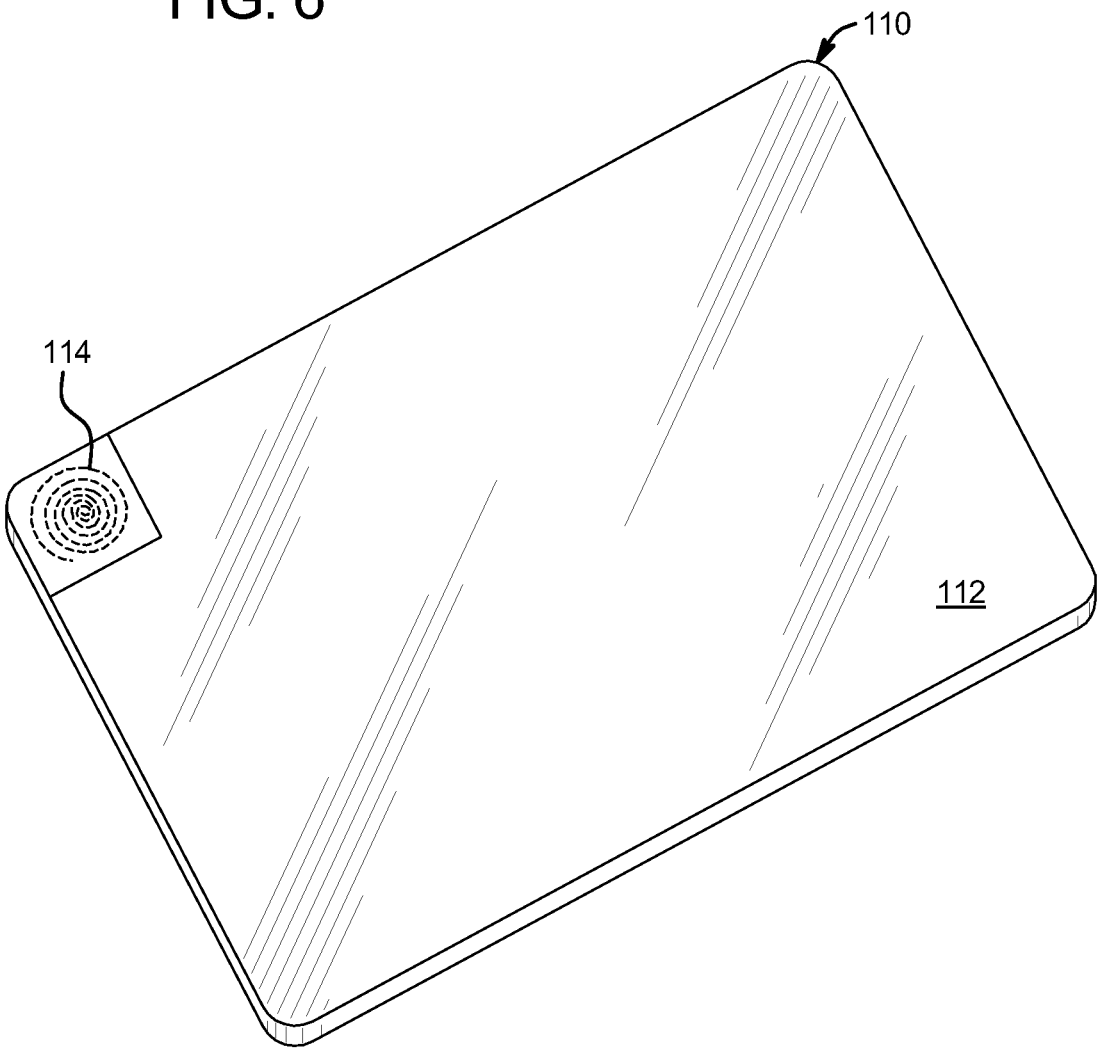
FIG. 6 illustrates one embodiment of an encoded or tagged player card operable with the multiple player simultaneous display/input device game table of the present disclosure.

More specifically, referring now to FIG. 6, a player card 110 illustrates one embodiment of a card encoded or tagged for operation with game table 100. Card 110 is in one embodiment the player's tracking card discussed above. Alternatively, card 110 is issued as a promotion by the casino. For example, when the player checks into the hotel and the player is recognized as a loyal patron to the hotel, the casino provides card 110 to the player as a promotion to the player and as an award for loyal patronage. It is also believed that such promotions can be a good introduction to players of the new different gaming experience that gaming system 10 and game table 100 offer.

Card 110, in one embodiment, is made of clear or transparent material 112, except for a section shown in the upper left hand corner of card 110, which holds encoding or tag 114, which is printed onto or formed in card 110. The encoding or tag 114 can be any suitable device such as a radio frequency tag, a barcode tag, or a dot coded tags. Card 110 can store or represent (or enable access to a system to that stores) any suitable information regarding the player, such as the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions Card 110, in one embodiment, is the same size as the player's hotel card or room key and in an alternative embodiment can perform this additional function.

Figure 7:
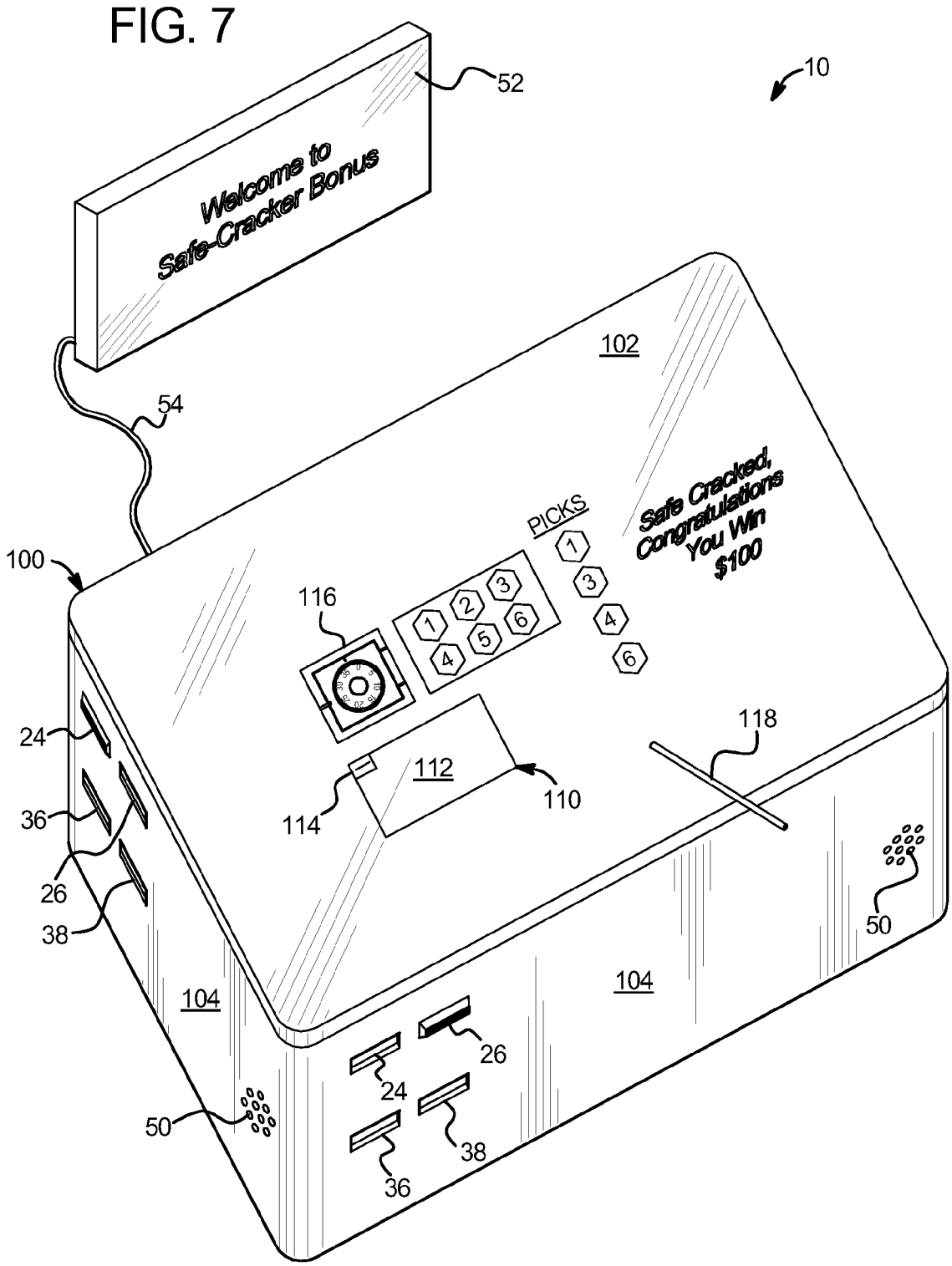
FIG. 7 illustrates one embodiment for using the card of FIG. 6 in a base or bonus game with the multiple player simultaneous display input device game table of the present disclosure.

Referring now to FIG. 7, gaming system 10, game table 100, and card 110 illustrate one example embodiment of a bonus game played in combination with any of the base games disclosed above, including the blackjack game of FIG. 5. In one embodiment, for example, the bonus is triggered when a player having a promotional game encoded on the player's card 110 places the card on surface of display/input device 102 of the display/input device of the game table when in an inactive or attract state. Game table 100 reads tag 114 of the card 110, determines the promotion, and because gaming system 10 is not currently playing the base game, triggers the promotional game, which in the illustrated embodiment of FIG. 7 is built around or adjacent to, under or otherwise in proximity to the player's card 110 on the surface display/input 102. Such arrangement enables multiple players each having a promotion encoded card 110 to play the bonus game simultaneously at game table 100. Overhead display 52 informs that the gaming system is now in a bonus mode. Card 110, in an alternative embodiment, is made of clear or transparent material 112, and the upper left hand section of card 110 holds an encoding or tag 114 which is printed onto or formed in card 110 in a suitable manner that is invisible to the naked eye, but visible to the optical recognition of the game table 100 (e.g., encoding tag 114 could be printed using infrared reactive ink or dye).

In this example embodiment, tag 114 is an identifier tag for the bonus game. The player is allowed to slide card 110 wherever the player wants to on surface of display/input device 102 of the game table 100 (except if too close to the game table's edge, so that the promotional game cannot be displayed). Game table 100 senses the location of tag 114 and builds the promotional game around adjacent to card 110 on the surface of display/input device 102 knowing the position of tag 114. In one embodiment, tag 114 includes two or more tags, so that gaming system 10 or game table 100 knows the orientation of the remainder of card 110 to the position of tag 114. Alternatively, tag 114 can be suitably shaped (e.g., triangular) so as to provide such orientation information. The game after being displayed moves with card 110 if the player moves the card. It should be appreciated that in these embodiments this card does not include an electronic processor, electronic transmitter or electronic receiver.

In the embodiment illustrated in FIG. 7, the promotional game is a number selection game, sometimes referred to her in as the "safecracker" game, which shows a safe 116 and a plurality of selectable numbers one to six adjacent to safe 116. Here, both safe 116 and numbers one to six are displayed directly adjacent the player's card 110. Game table 100 informs the payer to punch in a four digit code to open the safe. In this example embodiment, the player must actually pick two randomly chosen numbers needed to obtain an award located and do so by choosing four of six possible numbers. As illustrated, the player selects numbers "one", "three", "four" and "six". Game table 100 then either displays a "safe cracked" message and awards a prize or a "sorry, maybe next time" message and provides no award. The award can be monetary or non-monetary (such as tickets to a show or a free meal).

As seen in FIG. 7, the player has cracked the safe and won $100, which can be paid via ticket from ticket printer 36, credited to a credit or debit card at card reader 38, paid via a hand pay from an operator or credited to the player's card 110. These credits can be used in a base game, such as the base slot game shown in FIG. 5. If another player without a promotional card 110 wishes to also play the base game, the player can establish credits using coin slot 26, bill accepter 24, or have a game table host use a host wand 118 to open an account for the second player and credit the account via an account screen displayed at game table 100.

It should be appreciated that any other suitable selection game may be implemented in with the card, game table and game system. In various embodiments, one or more predetermined awards are associated with the card and when the player selects one or more displayed selections associated with the card placed on the game table, the gaming system selects one or more of the awards to provide to the player.

In an alternative embodiment, if the player is staying at the hotel of gaming system 10, the player can place his hotel card (which has a suitable tag in addition or in place of the magnetic strip or smart chip in currently known hotel cards) on game table 100, and the gaming system can determine the player, the player's hotel number, and other player information. In one such example embodiment, wagers and credit can be applied against a player account (such as against the player's hotel bill). Further alternatively, if the player is staying at the hotel of gaming system 10, the game table host can use the account screen to enter in the player's name or other identification that gaming system 10, which is linked to the hotel's guest system, can use to find the player's hotel account and credit the second player against that account. It should be appreciated that the hotel cards could have IR tags that are naked to the human eye.

Figure 8:
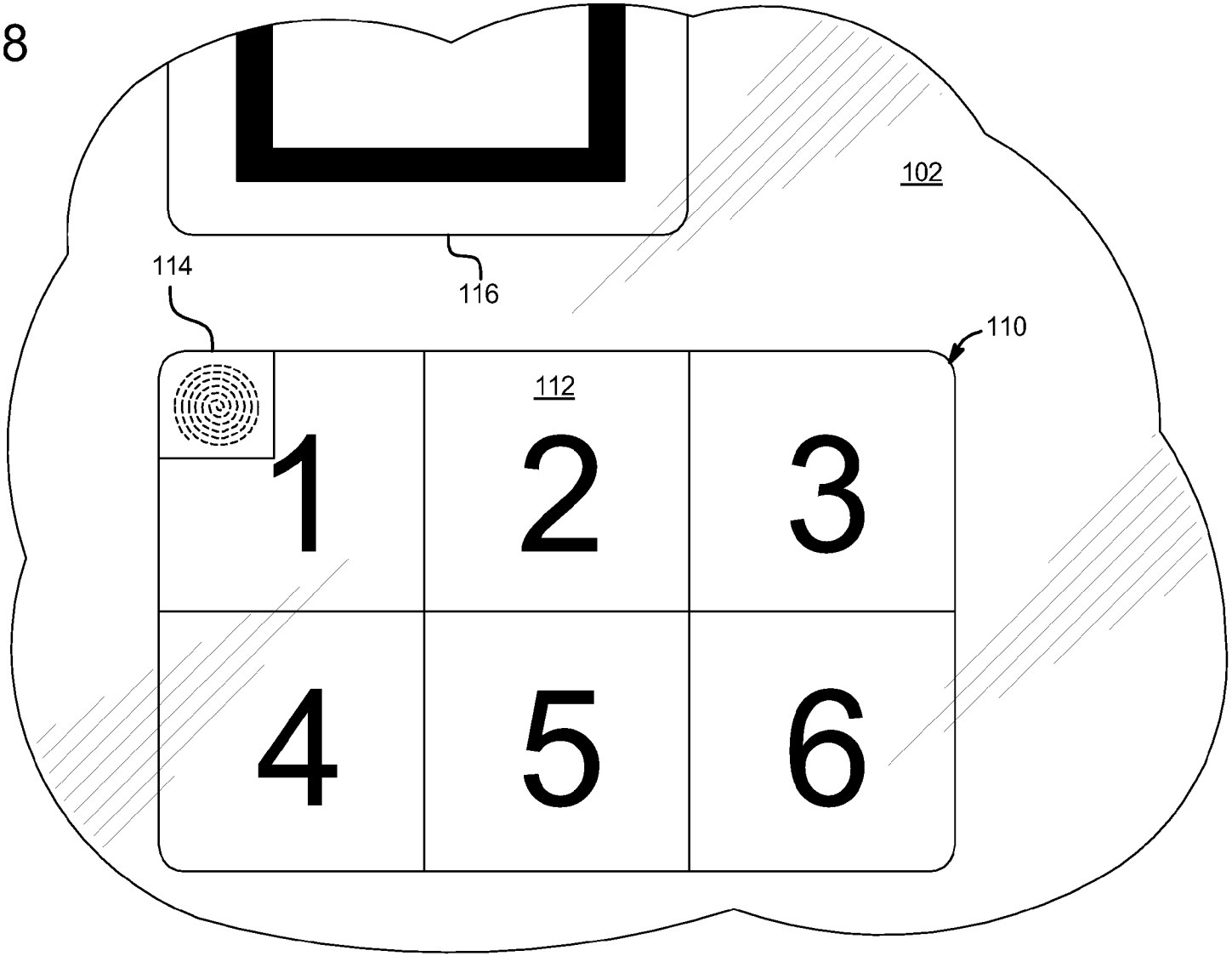
FIG. 8 illustrates another embodiment for using the card of FIG. 6 in a base or bonus game with the multiple player simultaneous display/input device game table of the present disclosure.

Referring now to FIG. 8, the promotional game described in relation to FIG. 7 is played alternatively by placing the selectable numbers one to six directly beneath card 110, which is see through (such as being transparent) in one embodiment such that the player can see the numbers through the card. The player presses card 110 at areas directly above the desired safecracker numbers such as numbers "one", "three", "four" and "six" selected above in FIG. 7. The IR capable cameras or readers used in one embodiment of game table 100 do not require that surface of display/input device 102 of game table 100 actually be touched. Here, the cameras sense (reflected light from) the player's finger at the small distance away from surface of display/input device 102 caused by the thickness of card 110.

It should further be appreciated that the use of or number of times each of the cards may be used can be limited or unlimited. For instance, each card may be usable a designated number of times (e.g., once for a promotion). It should also be appreciated that the cards may be disposable or recyclable after their use. It should further be appreciated that each card can be reset after a designated number of uses. Such cards can be collected by a gaming establishment after a use by a player (such as a use for a promotion) and then reset for a subsequent distribution to and use by another player. It should also be appreciated that the cards may be provided to people in any suitable manner (such as in promotion materials, check-in or registrations packages, coupon books, etc).

It should also be appreciated that awards can be associated with the cards in any suitable manner (e.g., randomly determined, predetermined, etc.). It should further be appreciated that for promotions, each card may be associated with an award or only certain cards may be associated with awards. It should further be appreciated that no awards may be associated with the distributed cards and that the gaming system or game table may determine if an award is associated with the card.

Another function of game table 100 of gaming system 10 is the ability of the gaming system to communicate with different peripheral devices wirelessly. While player cards can be used for fund transfer (to and from the player) and game play as described above or any other suitable game play, other peripheral devices, such as the player's personal digital assistant ("PDA") can also be used at certain times to enhance the gaming experience. As described below, the additional player device can be used to commemorate a win, provide a screen saver for the device or a player personal computer at home, store sounds for ring tones, and modify other of the player's personal items. It should also be appreciated that videos and other forms of data can be transferred back and forth between the game table to the players PDA. In one such embodiment, the gaming system facilitates an "instant replay" feature where certain information is saved for later playback.

In various embodiments, the player's PDA such as their cell phone must be registered with the gaming system to interact with the game table. The registration can include providing the device type and model number so that the gaming system knows the configuration of the device and that the gaming system is able to properly communicate with the device. Such devices also may need to have, in certain embodiments, a tag associated with the device so that the gaming system can properly determine or identity the device and user of the device. The registration may also include obtaining suitable information from the player. In alternative embodiments, other types of connections type can be set up between the game table or PDA. In one embodiment, a one-time setup could occur such as when a player joins a player tracking system. In such embodiments, a suitable software application can be sent to the player's device to facilitate communication between the PDA and the gaming system or game table.

Figure 9:
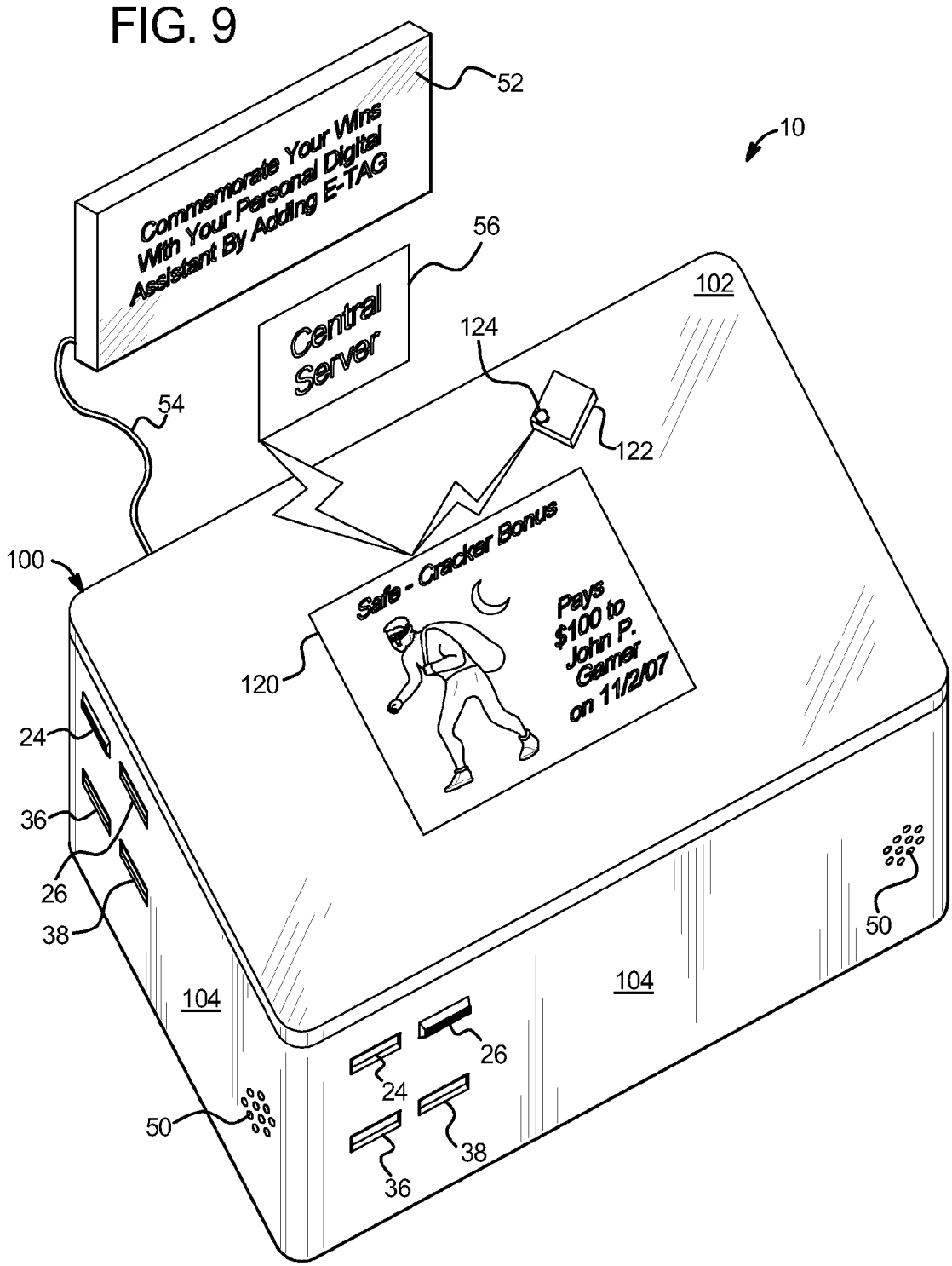
FIG. 9 illustrates the multiple player simultaneous display/input device game table of the present disclosure uploading a gaming image to the player's personal digital assistant.

Referring now to FIG. 9, once the player wins the safe-cracker bonus, via the embodiments of FIG. 7 or FIG. 8, game table 100 displays a player win or congratulations screen 120. The player is very happy with his or her promotional win and decides to capture the win on the player's PDA 122, which in the illustrated embodiment is encoded with a tag 124. The cameras or readers of game table 100 sense tag 124 as being that of a registered PDA. Processing 12 is configured such that when such a registered PDA tag 124 is sensed, and if the current screen is eligible to be uploaded to the player's PDA, to send the current screen via a suitable wireless technology (such as BLUETOOTH™, WI-FI™, ZIGBEE™ technology) to the player's PDA, which is configured to accept such a wireless digital transfer. The win screen is accordingly personalized on the player's PDA for later viewing.

Alternatively, the screen shot is sent wirelessly to a server within the casino, which sends the screenshot to the user's designated device or location such as the user's email address. Further alternatively, the placement of PDA 122 having tag 124 onto surface of display/input device 102 of game table 100 causes the win screen or a commemoration screen to be displayed and then sent wirelessly to PDA 122 or to the server, which sends the screen to the player's designated device or location such as the player's email address.

It should be appreciated that other devices may be employed with the game table besides the cards and other devices described above (such as other PDAs, wands, laptops, tablet computers, digital cameras, email devices, or any other suitable device that can communicate wirelessly with the game table). It should also be appreciated that the gaming system or game table could have alternative or extra devices to determine or interact with devices.

It should be appreciated that the gaming system of the present disclosure enables each of one or more players to simultaneously play one or more primary games and one or more secondary games. It should further be appreciated that the gaming system enables each of the players to readily switch back and forth between such games.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a game table having a single multiplayer display/input device; and at least one processor configured to operate with the single multiplayer display/input device to:

(a) identify a card which is placed on the game table, said card including a passive encoded pattern and wherein the single multiplayer display/input device is configured to identify the passive encoded pattern, (b) cause the single multiplayer display/input device to determine a position of the card on the game table, (c) cause the single multiplayer display/input device to display a plurality of selections associated with the card in relation to the position of the card on the game table, said selections having a stored pre-determined relationship with the card prior to the card being placed on the table, wherein the card is one of a plurality of different cards, and different selections have different stored pre-determined relationships with the different cards, (d) cause the single multiplayer display/input device to enable a player to input a pick of one of the displayed selections, (e) determine if any predetermined awards associated with the card are to be provided to the player based on the selection picked by the player, and (f) display any determined award.

2. The gaming system of claim 1, wherein the card has a pre-determined relationship with a promotion and any said determined award is provided as part of the promotion.

3. The gaming system of claim 1, wherein the card is see through and the at least one processor is configured to operate with the single multiplayer display/input device to display at least one of the selections under the card on the game table.

4. The gaming system of claim 1, wherein the card is see through and the at least one processor is configured to operate with the single multiplayer display/input device to display at least one of the selections adjacent to the card on the game table.

5. A gaming system comprising:

a game table having a single multiplayer display/input device; and at least one processor configured to operate with the single multiplayer display/input device to:

(a) identify a card which is placed on the game table, said card including at least two passive encoded patterns and wherein the single multiplayer display/input device is configured to identify the passive encoded patterns, (b) cause the single multiplayer display/input device to determine a position and an orientation of the card on the game table based on a plurality of the encoded patterns, (c) randomly select an award associated with the card from a plurality of possible predetermined awards associated with the card, and (d) cause the single multiplayer display/input device to display any award resulting from said random selection associated with the card in relation to the position and the orientation of the card on the game table.

6. The gaming system of claim 5, wherein the card is associated with a promotion and any selected award is provided as part of the promotion.

7. The gaming system of claim 5, which requires a wager to be made by a player to perform the random determination.

8. The gaming system of claim 5, which does not require a wager to be made by a player to perform the random determination.

9. The gaming system of claim 5, wherein the card is see through and the at least one processor is configured to operate with the single multiplayer display/input device to display the selected award under the card on the game table.

10. The gaming system of claim 5, wherein the at least one processor is configured to operate with the single multiplayer display/input device to display the selected award adjacent to the card on the game table.

11. A gaming system comprising:

a game table having a single multiplayer display/input device; and at least one processor configured to operate with the multiplayer display/input device to:

(a) identify a card which is placed on the game table by a player, said card including a passive encoded pattern and associated with a promotion, wherein the single multiplayer display/input device is configured to identify the passive encoded pattern, wherein the card is at least partially see through, (b) cause the single multiplayer display/input device to determine a position of the card on the game table, (c) cause the single multiplayer display/input device to display a play of a promotional game relative to the position of the card and at least partially under the see through portion of the card on the game table without requiring the player to make any wager, and (d) cause the single multiplayer display/input device to display any award resulting from said play of the promotional game to the player.

12. The gaming system of claim 11, wherein the at least one processor is configured to operate with the single multiplayer display/input device to display the play of the promotional game adjacent to the card on the game table.

13. A gaming system comprising:

a game table having a single multiplayer display/input device;

a receiver;

a transmitter; and at least one processor configured to operate with the single multiplayer display/input device, the receiver and the transmitter to:

(a) display a play of a game, said game being one of a primary wagering game, a secondary game, and a promotional game, (b) identify a communication device which is placed on the single multiplayer display/input device of the game table, (c) after the play of the game, if the play of the game results in a designated winning outcome, enable the player to request to upload a first selected image from the play of the game representing the designated winning outcome, and if the player request said upload, after the play of the game, cause the transmitter to transfer first data representing the first selected image from said play of the game to the communication device for subsequent display by the communication device, (d) cause the receiver to receive second data representing a second selected image which is stored on and electronically sent from the communication device to the receiver, and (e) cause the single multiplayer display/input device to display the second selected image based on the second data.

14. The gaming system of claim 13, wherein communication device is selected from the group consisting of: a personal digital assistant, a digital camera, an email device, and a cellular telephone.

15. The gaming system of claim 13, wherein a passive encoded pattern is attached to the communication device, and the single multiplayer display/input device is configured to identify the passive encoded pattern.

16. The gaming system of claim 13, wherein the at least one processor is configured to operate with the transmitter to transfer data representing at least one of a plurality of selected images and a plurality of selected sounds from said play of the game to the communication device for subsequent display by the communication device.

17. The gaming system of claim 13, wherein the at least one processor is configured to operate with the transmitter to transfer data representing a plurality of selected sounds from said play of the game to the communication device for subsequent display by the communication device.

18. The gaming system of claim 13, wherein the at least one processor is configured to operate with the transmitter to transfer data representing at least one of the casino name at which the designated winning outcome occurred and a time at which the designated winning outcome occurred.

* * * * *